US012268951B2

(12) United States Patent
Indulti et al.

(10) Patent No.: US 12,268,951 B2
(45) Date of Patent: Apr. 8, 2025

(54) REAR PORTION OF A SKI MOUNTAINEERING BINDING

(71) Applicant: ATK SPORTS S.r.l., Fiorano Modenese (IT)

(72) Inventors: Davide Indulti, Fiorano Modenese (IT); Marco Solarino, Reggio Emilia (IT)

(73) Assignee: ATK SPORTS S.r.l. (IT)

( * ) Notice: Subject to any disclaimer, the term of this patent is extended or adjusted under 35 U.S.C. 154(b) by 132 days.

(21) Appl. No.: 18/108,258

(22) Filed: Feb. 10, 2023

(65) Prior Publication Data

US 2023/0256319 A1 Aug. 17, 2023

(30) Foreign Application Priority Data

Feb. 11, 2022 (IT) ..... 102022000002501
Sep. 6, 2022 (IT) ..... 102022000018186

(51) Int. Cl.
*A63C 7/00* (2006.01)
*A63C 9/00* (2012.01)

(52) U.S. Cl.
CPC ..... *A63C 7/005* (2013.01); *A63C 9/003* (2013.01)

(58) Field of Classification Search
CPC ..... A63C 7/005; A63C 9/003
See application file for complete search history.

(56) References Cited

U.S. PATENT DOCUMENTS 4,216,976 A * 8/1980 Krob ..... A63C 9/0842 280/605
4,386,789 A * 6/1983 Horn ..... A63C 7/1053 280/605
5,516,141 A * 5/1996 Stritzl ..... A63C 7/104 188/6
8,919,805 B2 * 12/2014 Giordani ..... A63C 9/086 280/623
9,016,712 B2 * 4/2015 Giordani ..... A63C 9/0845 280/617
11,701,571 B2 * 7/2023 Indulti ..... A63C 7/108 280/605

(Continued)

FOREIGN PATENT DOCUMENTS

DE 102013224571 A1 * 6/2015 ..... A63C 7/1026
EP 2638937 A1 * 9/2013 ..... A63C 7/1026

(Continued)

*Primary Examiner* — Jacob B Meyer
(74) *Attorney, Agent, or Firm* — Endurance Law Group PLC

(57) ABSTRACT

A rear portion of a ski mountaineering binding has a base with a turret rotatable into a first position. The binding portion attaches to a ski boot heel for downhill skiing. The turret has a second position for walking uphill. A ski brake includes a braking lever rotatable to assume a braking position and a non-active position. The brake has elastic for rotating the braking lever towards the braking position, the braking lever is pressed by the ski boot heel, when the turret is in the first position, in order to reach the non-active position. A rotation member rotatably borne by the base bears the braking lever. The rotation member and the turret are interconnected and solidly constrained to one another, with the turret in the second turret position and the braking lever in the non-active position, to enable walking uphill.

14 Claims, 22 Drawing Sheets

(56) References Cited

U.S. PATENT DOCUMENTS

| | | | | |
|---|---|---|---|---|
| 11,806,605 | B2 * | 11/2023 | Indulti | A63C 9/08528 |
| 11,998,832 | B2 * | 6/2024 | Eckart | A63C 9/006 |
| 2013/0181427 | A1 * | 7/2013 | Fritschi | A63C 9/006<br>280/614 |
| 2020/0129839 | A1 * | 4/2020 | Indulti | A63C 9/08564 |
| 2023/0256319 | A1 * | 8/2023 | Indulti | A63C 7/005<br>280/604 |
| 2023/0347231 | A1 * | 11/2023 | Indulti | A63C 9/22 |

FOREIGN PATENT DOCUMENTS

| | | | | | |
|---|---|---|---|---|---|
| EP | 2774660 | A2 * | 9/2014 | | A63C 7/1026 |
| EP | 3560563 | A1 * | 10/2019 | | A63C 7/1026 |
| EP | 3827887 | A1 * | 6/2021 | | A63C 7/1033 |
| EP | 4091684 | A1 * | 11/2022 | | A63C 7/1026 |
| EP | 4180096 | A1 * | 5/2023 | | A63C 7/104 |
| EP | 4226980 | A1 * | 8/2023 | | A63C 7/005 |
| FR | 3123225 | A1 * | 12/2022 | | |
| IT | 202100016991 | A1 * | 12/2022 | | |
| IT | 202100029006 | A1 * | 5/2023 | | |
| IT | 202200002501 | A1 * | 8/2023 | | |
| WO | WO-2009153615 | A1 * | 12/2009 | | A63C 9/006 |
| WO | WO-2012024809 | A1 * | 3/2012 | | A63C 7/1053 |

* cited by examiner

REAR PORTION OF A SKI MOUNTAINEERING BINDING

BACKGROUND OF THE INVENTION

The present invention relates to the technical sector concerning a ski mountaineering binding, with particular reference to a rear portion of the ski mountaineering binding provided with a brake for skis.

DESCRIPTION OF THE PRIOR ART

Prior-art document EP3409332B1 describes a rear portion of a ski mountaineering binding in which:

- it comprises a base which is fixable to a ski;
- it comprises a turret which is borne by the base and which is rotatable with respect to the base in order to assume a first turret position, in which it is hookable to the heel of a ski boot, so that it is possible to ski downhill, and in order to assume a second turret position, in which it is not hookable to the heel of a ski boot, so that it is possible to walk uphill;
- it comprises a brake for a ski which is fixable to the ski and which is able to assume a braked configuration, in which it brakes the ski, and a non-active configuration in which it is non-active;
- it comprises first elastic means which are arranged so as to exert a force which tends to bring the brake into the braked configuration;
- it comprises a hooking member which: is borne by the base; frontally comprises a hook for hooking the brake; is movable along a movement path which is longitudinal to the axis of the ski between a disengaged configuration, in which the hook is retracted and not able to hook the brake, and an engaged configuration, in which the hook is advanced and can hook the brake when the brake is brought into the non-active configuration, thus stably maintaining the brake in the non-active configuration;
- it comprises second elastic means interposed between the base and the hooking member, in order to exert a force which tends to push the hooking member into the engaged configuration;
- the hooking member posteriorly comprises a cam follower on which the turret acts via an appropriate cam, so that when the turret is in the first turret position then the hook is retracted and so that when the turret is in the second turret position then the hook is released and is advanced to hook the brake.

Further, the brake comprises a braking lever which is arranged so that it can be pressed by the heel of a ski boot when the heel of the ski boot hooks the turret in the first turret position, for downhill skiing. The brake is also designed in such a way that the pressure of the braking lever by the heel of the ski boot brings the brake to assume the non-active configuration, against the action of the first elastic means.

There follows a description of the functioning. Consider first the turret in the first turret position, the hooking member in the disengaged configuration and the brake in the braked configuration. To ski downhill, it is necessary only to hook the heel of the ski boot to the turret, which brings the brake into the non-active configuration.

Thereafter, in order to be able to ski uphill the heel of the ski boot is disengaged from the turret and the turret rotates so that it assumes the second turret position: as a consequence, the hooking member reaches the engaged configuration. Thereafter, it is necessary to press the braking lever towards the base: as a consequence, the brake moves into the non-active configuration and the hook engages the brake, keeping it stably in the non-active configuration.

To return to downhill skiing, it is sufficient to rotate the turret to bring it newly into the first turret position: consequently, the hooking member reaches the disengaged configuration and the brake is released, reaching the braked configuration due to the action of the first elastic means.

The aim of the invention consists in improving the reliability of the rear portion of a ski mountaineering binding.

The above aim is attained by a rear portion of a ski mountaineering binding, according to claim 1, as the second elastic means are not necessary. Consequently, there are also lower maintenance costs.

DESCRIPTION OF THE DRAWINGS

Specific embodiments of the invention will be described in the following, according to what is set down in the claims and with the aid of the accompanying tables of drawings, in which:

DESCRIPTION OF THE PREFERRED EMBODIMENTS

Figure 1:
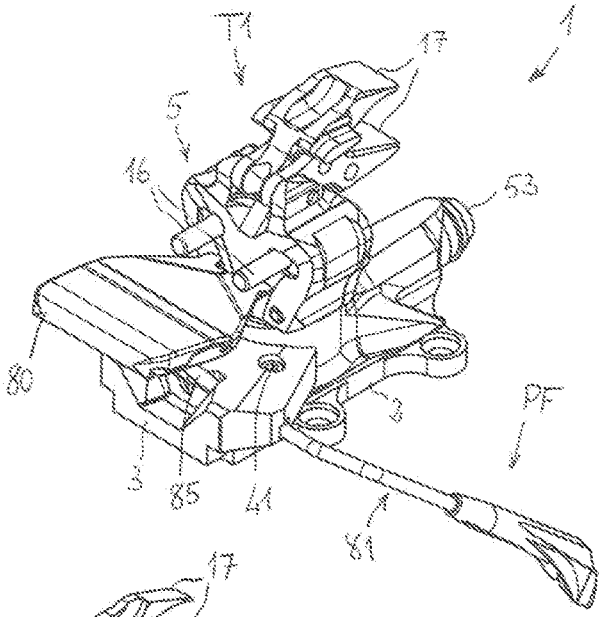
FIGS. 1, 2, 3 are respectively an axonometric view, in plan view and from below of a rear portion of a ski mountaineering binding according to a first embodiment of the invention, in a configuration in which a relative turret is in the first turret position for downhill skiing and wherein a braking lever of a relative brake is in a braking position.
Figure 5:
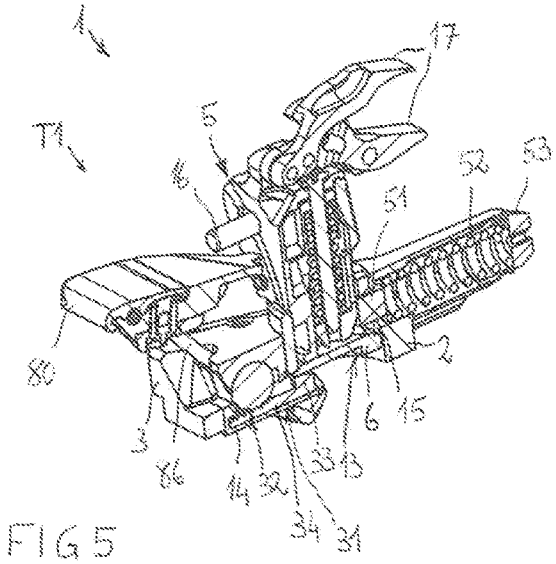
FIG. 5 is alike to FIG. 4, with the difference that it is an axonometric view.
Figure 4:
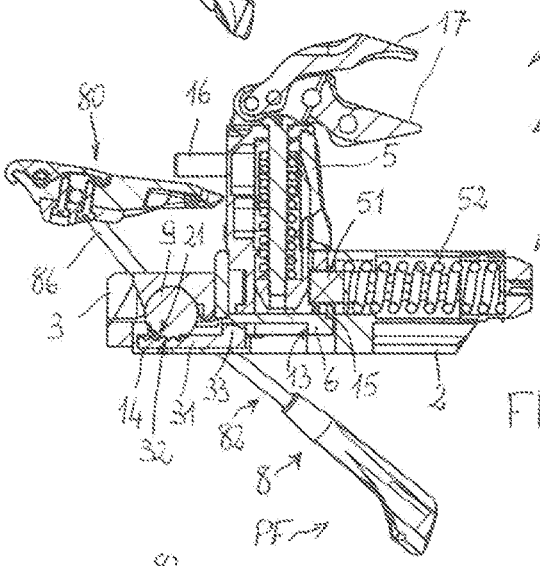
FIG. 4 is a view of section IV-IV of FIG. 2.
Figure 2:
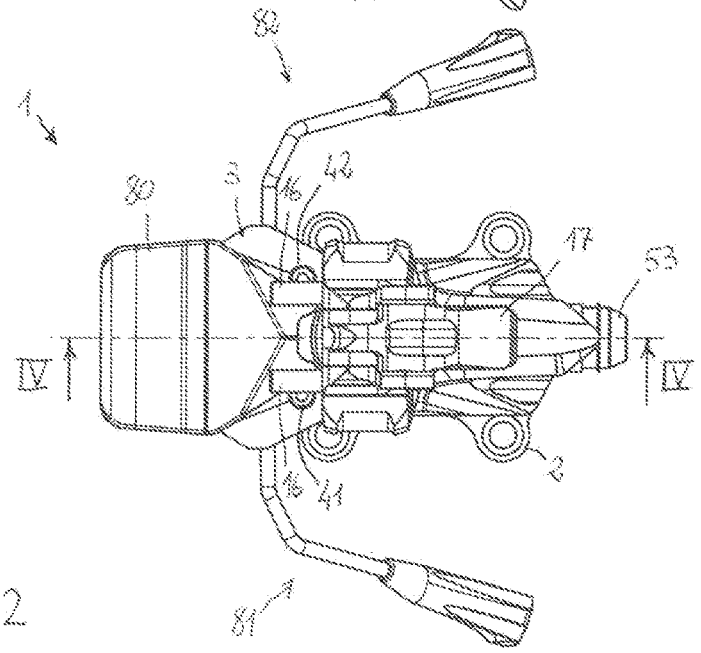
Figure 3:
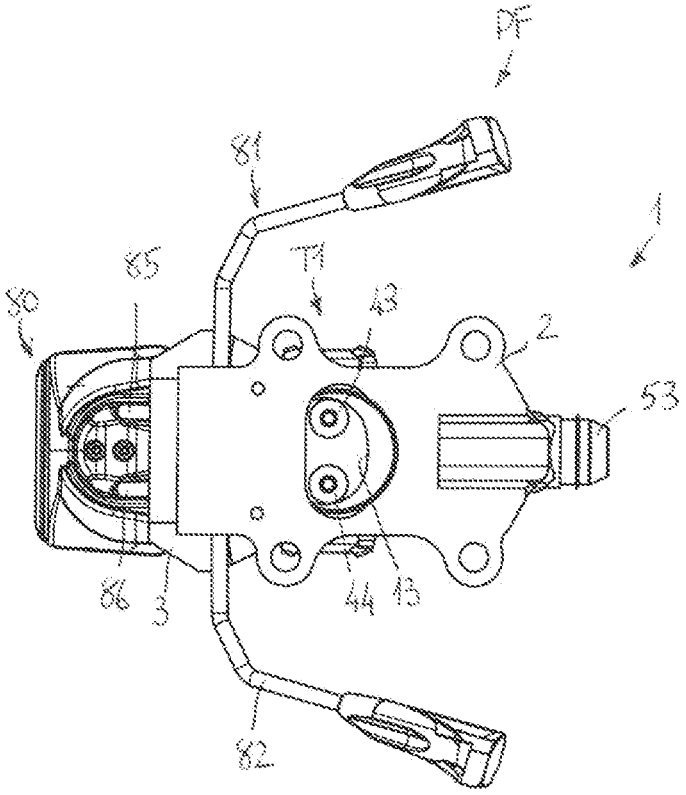
Figure 6:
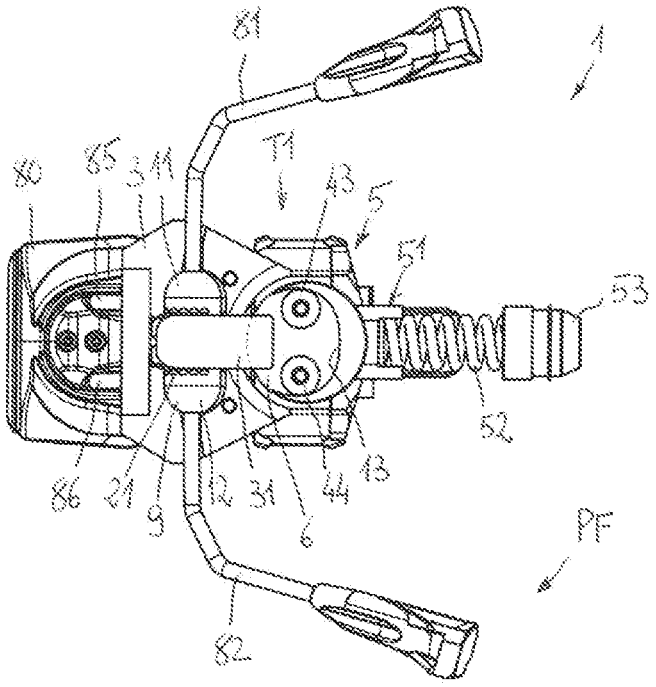
FIGS. 6, 7 are respectively a view from below and a lateral view of the rear portion of the ski mountaineering binding of FIGS. 1-3 in which a first portion of base has been removed.
Figure 7:
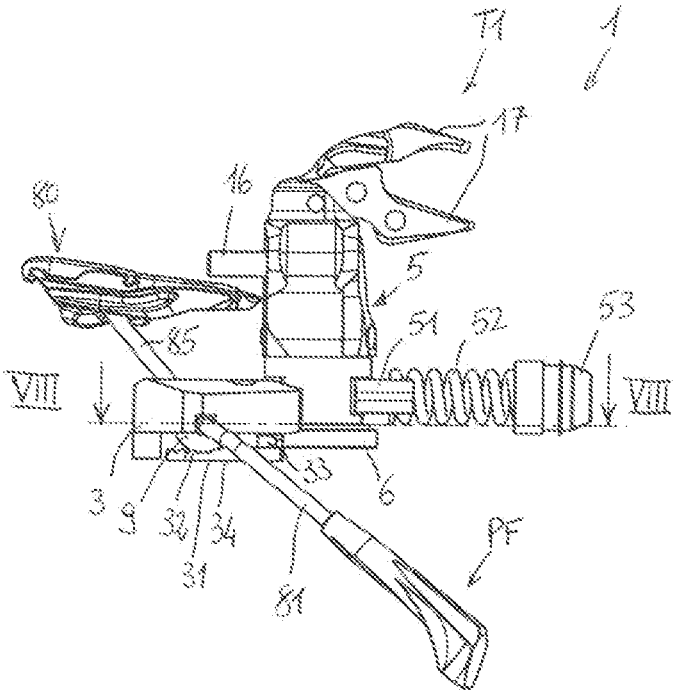
Figure 8:
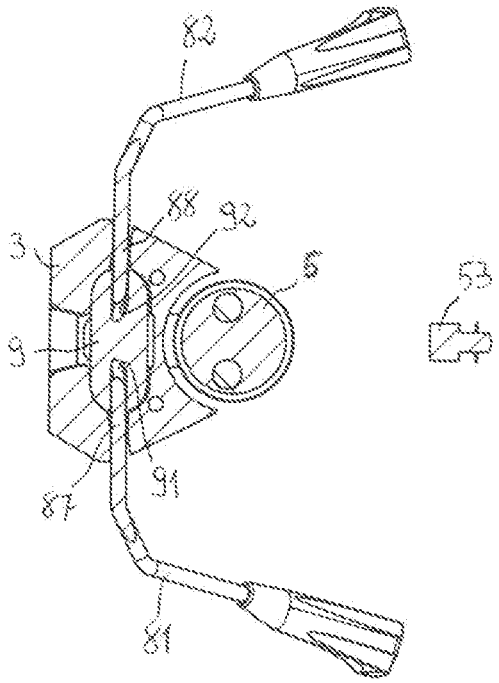
FIG. 8 is a view of section VIII-VIII of FIG. 7.
Figure 9:
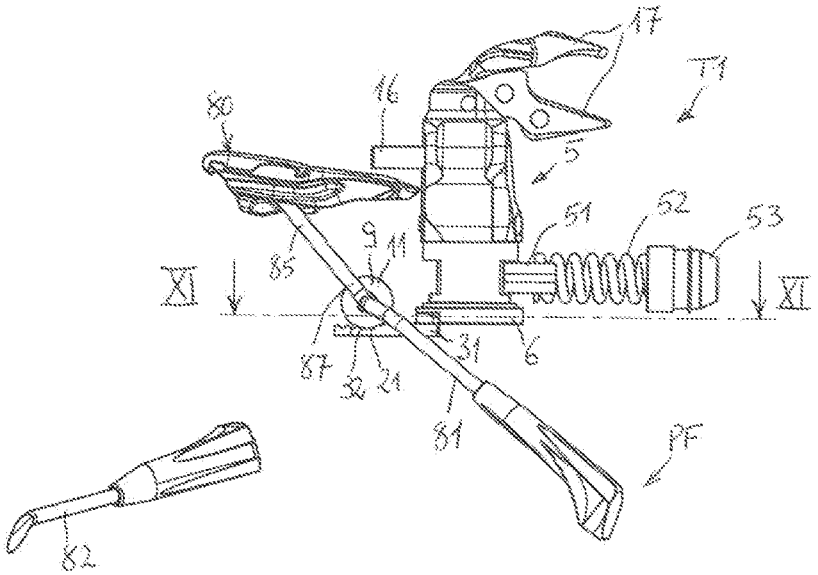
FIGS. 9, 10 are respectively a lateral view and an axonometric view from below of the rear portion of the ski mountaineering binding of FIGS. 1-3 in which the first portion of base has been removed and a second portion of base.
Figure 11:
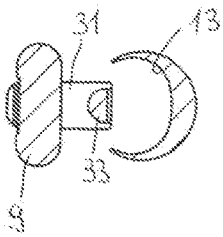
FIG. 11 is a view of section XI-XI of FIG. 9.
Figure 10:
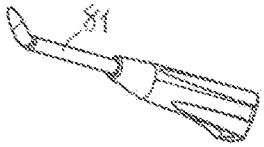
Figure 10:
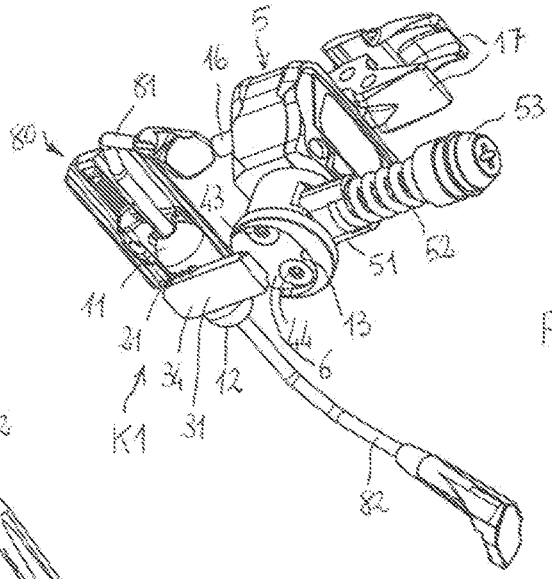
Figure 12:
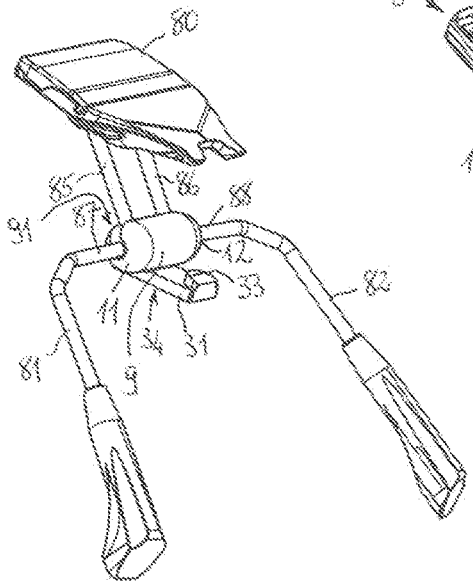
FIG. 12 is an axonometric view of detail K1 of FIG. 10.
Figure 15:
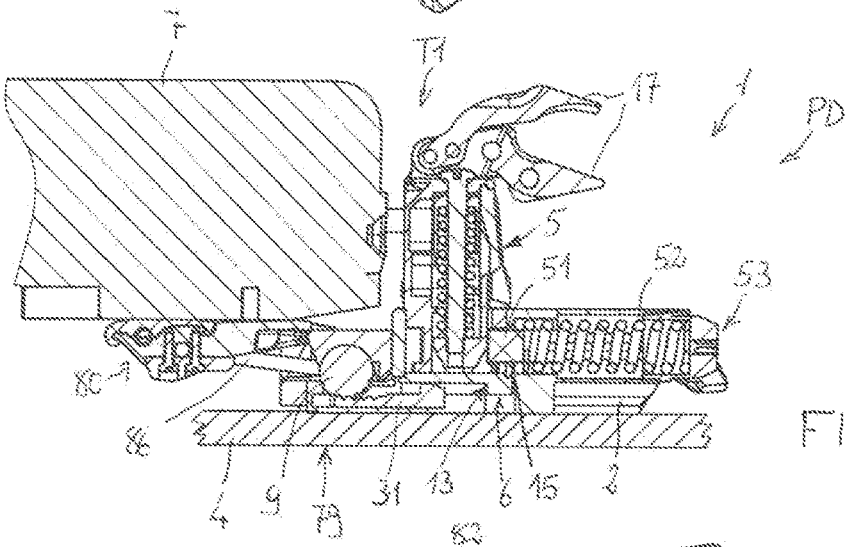
FIG. 15 is a view of section XV-XV of FIG. 14, which additionally illustrates the portion of a ski.

With reference to the appended tables of drawings, reference numeral (1) denotes in its entirety a rear portion of a ski mountaineering binding according to the present invention, wherein:

- it comprises a base (2, 3) which is fixable to a ski (4) (a portion of ski (4) has been shown only in FIG. 15);
- it comprises a turret (5, 6) which is borne by the base (2, 3) and which is rotatable with respect to the base (2, 3) in order to assume a first turret position (T1), wherein it is fixable to the heel (7) of a ski boot, so that it is possible to ski downhill, and in order to assume a second turret position (T2), wherein it is not fixable to the heel (7) of a ski boot, so that it is possible to walk uphill;
- it comprises a brake (8, 81, 82, 83, 84, 85, 86, 87, 88, 89) for a ski (4);
- the brake (8, 81, 82, 83, 84, 85, 86, 87, 88, 89) comprises a braking lever (8) which is rotatable to assume a braking position (PF), in which it can brake a ski (4) when the base (2, 3) is fixed to the ski (4), and a non-active position (PD) in which it is non-active;
- the brake (8, 81, 82, 83, 84, 85, 86, 87, 88, 89) comprises first elastic means (not illustrated) for rotating the braking lever (8) towards the braking position (PF);

the braking lever (8) is arranged so as to be pressed (directly or indirectly, as will be described) by the heel (7) of the ski boot, when the base (2, 3) is fixed to the ski (4) and the turret (5, 6) is in the first turret position (T1), in order to reach the non-active position (PD) against the action of the first elastic means;

it comprises a rotation member (9) which is rotatably borne by the base (2, 3) and which in turn bears the braking lever (8) so that a rotation of the rotation member (9) corresponds to a rotation of the braking lever (8), and vice versa;

it comprises connecting means (31, 32, 33, 35, 37) which connect the rotation member (9) and the turret (5, 6) to one another, in such a way that the rotation member (9) and the turret (5, 6) are solidly constrained to one another, when the turret (5, 6) is in the second turret position (T2) and when the braking lever (8) is in the non-active position (PD), so that it is possible to walk uphill.

The rear portion of a ski mountaineering binding (1) preferably comprises, or is identified with, a heel-piece of a ski mountaineering binding.

The brake (8, 81, 82, 83, 84, 85, 86, 87, 88, 89) for a ski (4) is preferably borne by the base (2, 3).

The rotation member (9) and the braking lever (8) are preferably solidly constrained to one another. In this way, a rotation of the rotation member (8) corresponds to a rotation of the braking lever (9), and vice versa.

The rotation member (9) preferably comprises a cylindrical portion for oscillating with respect to the transversal axis to the axis of the ski (4), when the base (2, 3) is fixed to the ski (4); the cylindrical portion comprises a first housing (91) (see for example FIG. 23) in which an intermediate portion (83) of the braking lever (8) is housed; the braking lever (8) comprises an activation arm (84) so as to be pressed by the heel (7) of the ski boot; the braking lever (8) comprises a first brake arm (81) which projects beneath the rest surface (79) of the ski (4), when the base (2, 3) is fixed to the ski (4) and the braking lever (8) is in the braking position (PF), and which is above the rest surface (79) of the ski (4), when the base (2, 3) is fixed to the ski (4) and the braking lever (8) is in the non-active position (PD); the activation arm (84) and the first brake arm (81) are opposite one another with respect to the intermediate portion (83) of the braking lever (8).

The cylindrical portion is preferably suitable for oscillating about an axis which, in particular, is perpendicular to the axis of the ski (4), when the base (2, 3) is fixed to the ski (4).

Preferably: the braking lever (8) comprises a second brake arm (82) which projects beneath the rest surface (79) of the ski (4), when the base (2, 3) is fixed to the ski (4) and the braking lever (8) is in the braking position (PF), and which is above the rest surface (79) of the ski (4), when the base (2, 3) is fixed to the ski (4) and the braking lever (8) is in the non-active position (PD); the second brake arm (82) is connected to the intermediate portion (83) of the braking lever (8); the first brake arm (81) and the second brake arm (82) are arranged in such a way that the ski (4) is interposed between the first brake arm (81) and the second brake arm (82), when the base (2, 3) is fixed to the ski (4). In other words, the first brake arm (81) and the second brake arm (82) can be located away from one another by a distance that is greater than the width of the ski (4) and be arranged respectively on opposite sides of the ski (4), when the base (2, 3) is fixed to the ski (4).

Figure 23:
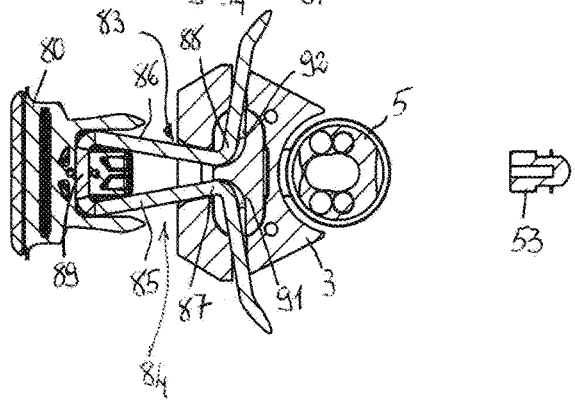
FIG. 23 is a view according to section XXIII-XXIII of FIG. 22.
Figure 24:
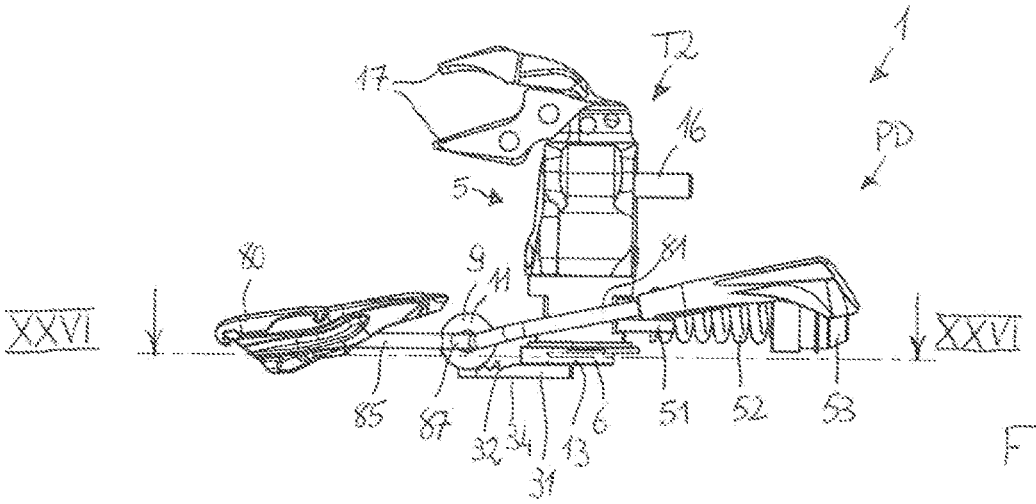
FIGS. 24, 25 are respectively a lateral view and an axonometric view from below of the rear portion of the ski mountaineering binding of FIGS. 16-18 in which the first portion of base and the second portion of base have been removed.
Figure 26:
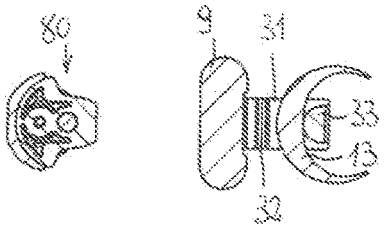
FIG. 26 is a view according to section plane XXVI-XXVI of FIG. 9.
Figure 25:
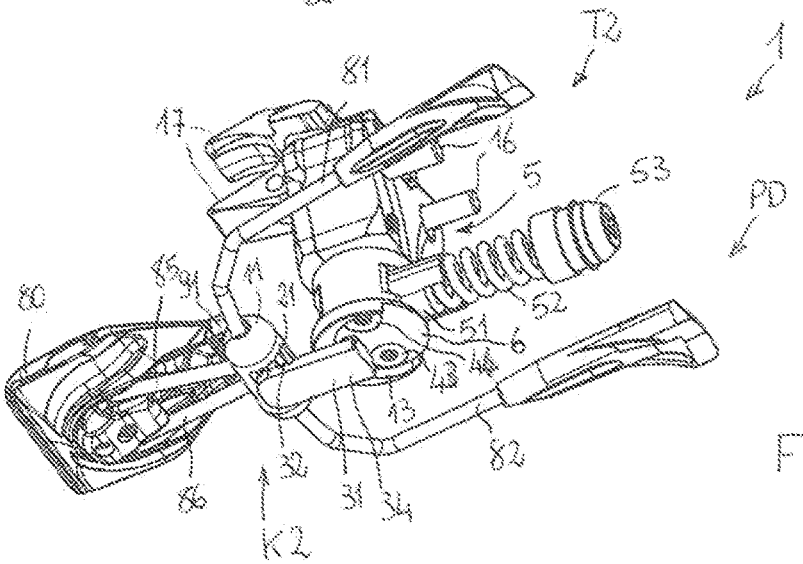
Figure 27:
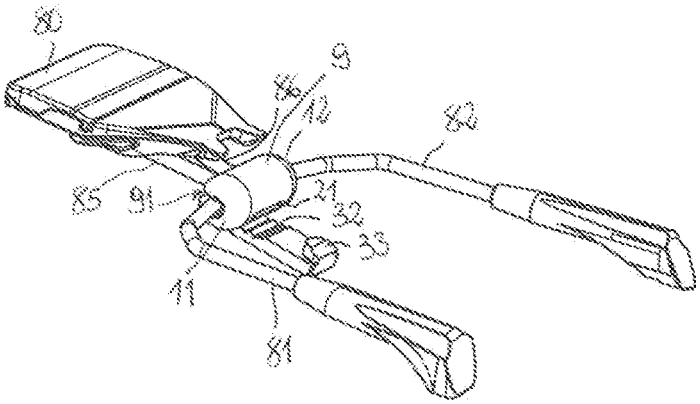
FIG. 27 is an axonometric view of detail K2 of FIG. 25.
Figure 28:
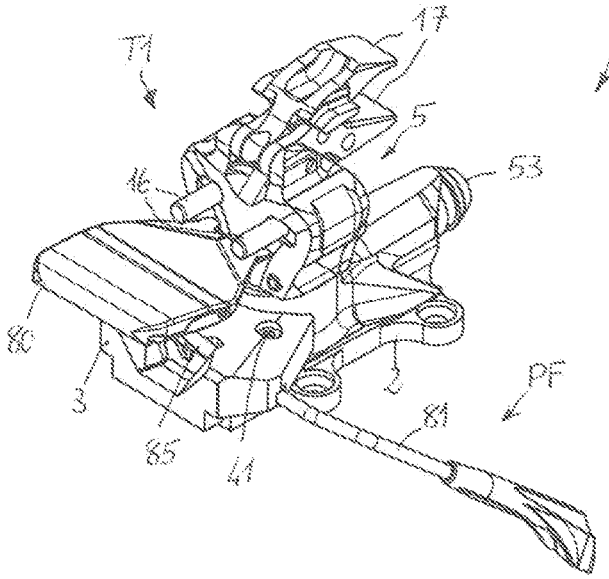
FIGS. 28, 29, 30 are respectively an axonometric view, in plan view and from below of a rear portion of a ski mountaineering binding according to a second embodiment of the invention, in a configuration in which a relative turret is in the first turret position for downhill skiing and in which a braking lever of a relative brake is in a braking position.

Preferably: the braking lever (8) is wire-shaped; the activation arm (84) of the braking lever (8) comprises a first prong (85) and a second prong (86) which are solidly constrained to one another (see for example FIG. 23);

the intermediate portion (83) of the braking lever (8) comprises a first L-shaped element (87) which is connected, at an end, to the first prong (85) and, at the other end, to the first brake arm (81), a second L-shaped element (88) which is connected, at an end, to the second prong (86) and, at the other end, to the second brake arm (82); the first L-shaped element (87) is housed in the first housing (91) of the rotation member (9); the rotation member (9) comprises a second housing (92); the second L-shaped element (88) is housed in the second housing (92) of the rotation member (9).

The braking lever (8) can be a rod, for example made of metal, or a hook, for example made of metal. The braking lever (8) can be made in a single body.

The activation arm (84) can have a U-shape, see for example FIG. 23: in this case it comprises a connecting section (89) which connects the first prong (85) and the second prong (86), to form a single body.

The rotation member (9) preferably has a first base (11) and a second base (12) which are opposite one another; the first housing (91) of the rotation member (9) forms a first radial undercut which extends parallel to the axis of the same rotation member (9) starting from the first base (11); the second housing (92) of the rotation member (9) forms a second radial undercut which extends parallel to the axis of the same rotation member (9) starting from the second base (12).

The first radial undercut and the second radial undercut are preferably aligned to one another with respect to an axis which is parallel to the axis of the rotation member (9), see for example FIG. 23.

According to a first embodiment (FIGS. 1-27): the rotation member (9) is provided with a first arched cogging (21); the turret (5, 6) comprises a cam (13); the connecting means (31, 32, 33) comprise a connecting element (31) which is movable by translation, and which comprises a second straight cogging (32) and a cam follower (33); the connecting element (31) is coupled to the rotation member (9) by enmeshing of the relative second straight cogging (32) with the first arched cogging (21) so that a translating movement of the connecting element (31) determines a rotation of the rotation member (9), and vice versa; the cam (13) of the turret (5, 6) engages with the cam follower (33) of the connecting element (31) when the turret (5, 6) is rotated from the first turret position (T1) to the second turret position (T2), so that the connecting element (31) translates and generates a first rotation torque on the rotation member (9) which brings the braking lever (8) into the non-active position (PD), against the action of the first elastic means.

This advantageously simplifies the operations that the user has to perform in order to ski downhill or uphill: in fact, in order to predispose the rear portion of the ski mountaineering binding (1) for descent, after having walked uphill, the user only has to rotate the turret (5, 6) to bring it into the first turret position (T1); in order to predispose the rear portion of the ski mountaineering binding (1) for the ascent, after having skied downhill, the user only has to rotate the turret to bring it into the second turret position.

The first arched cogging (21) is preferably made at the cylindrical portion of the rotation member (9).

The base (2, 3) is preferably provided with a guide (14) and the connecting element (31) forms (see for example FIG. 10), or is provided with, a carriage (34) which is slidable along the guide (14).

The guide (14) can have an axis which is parallel to the axis of the ski (4) when the base (2, 3) is fixed to the ski (4), so that the connecting element (31) is movable parallel to the axis of the ski (4).

The cam follower (33) and the second straight cogging (32) can be included on a same side of the connecting element (31), which side is facing towards the turret (5, 6); the cam follower (33) can project with respect to the second straight cogging (32).

The cam (13) is preferably arranged on the bottom of the turret (5, 6).

Figure 36:
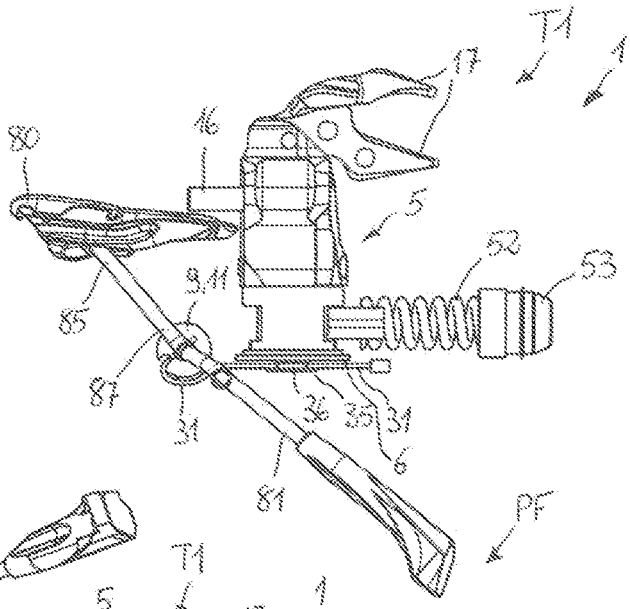
FIGS. 36, 37 are respectively a lateral view and an axonometric view from below of the rear portion of the ski mountaineering binding of FIGS. 28-30 in which the first portion and a second portion of base have been removed.
Figure 50:
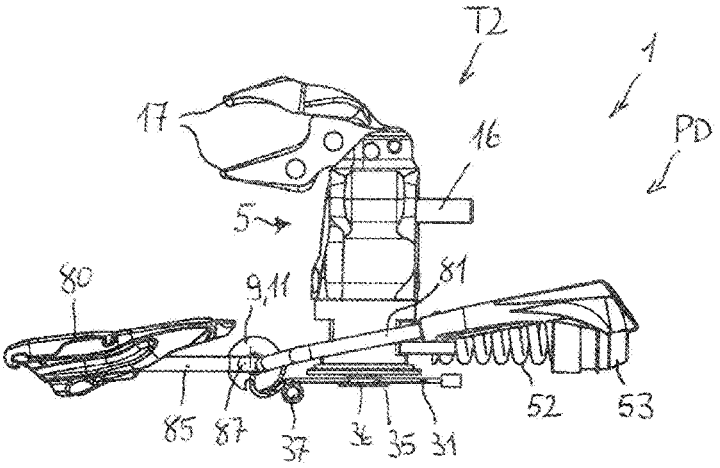
FIGS. 50, 51 are respectively a lateral view and an axonometric view from below of the rear portion of the ski mountaineering binding of FIGS. 42-44 in which the first portion of base and the second portion of base have been removed.
Figure 51:
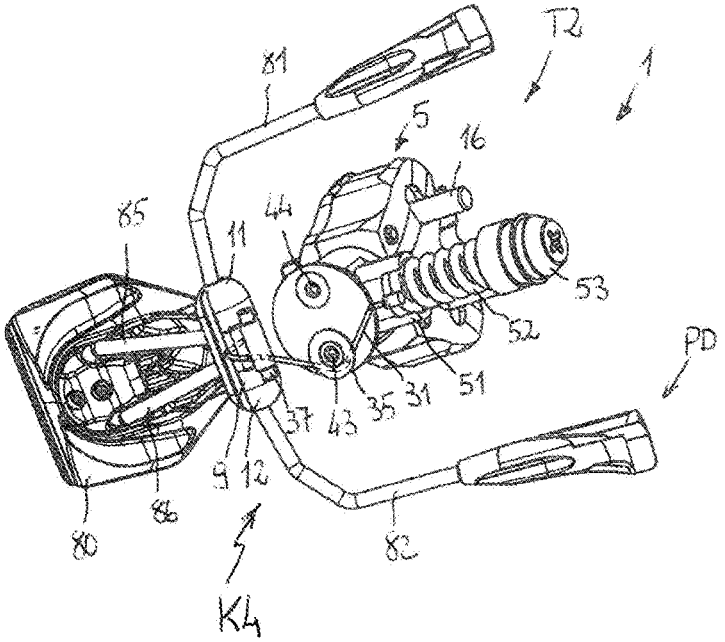
Figure 52:
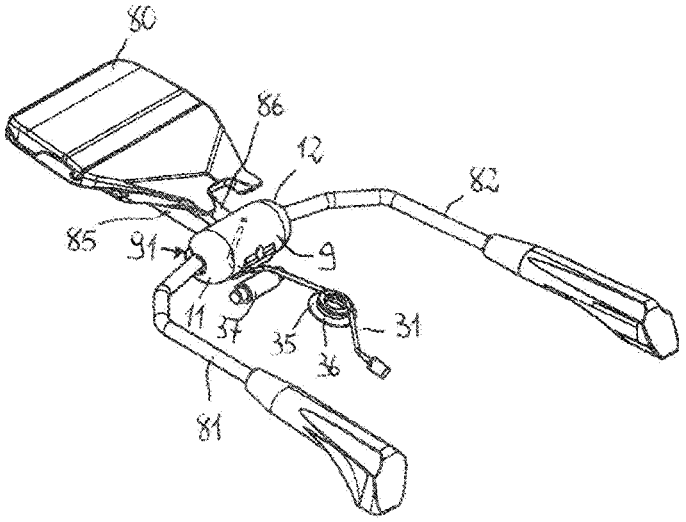
FIG. 52 is an axonometric view of detail K4 of FIG. 51.

According to a second embodiment (FIGS. 28-52): the connecting means (31, 35, 37) comprise a connecting element (31), which, on one side, is fixed to the rotation member (9) in a position such that it partially winds (see for example FIGS. 36 and 50) around the rotation member (9) and, on the other side, it is solidly constrained to the base (2, 3); the connecting means (31, 35, 37) comprise a first abutting element (35) which is borne by the turret (5, 6); the connecting element (31) and the first abutting element (35) are arranged with respect to one another in such a way that when the turret (5, 6) is rotated from the first turret position (T1) to the second turret position (T2) the first abutting element (35) abuts the connecting element (31) generating a second rotation torque on the rotation member (9) which brings the braking lever (8) into the non-active position (PD), against the action of the first elastic means.

This advantageously simplifies in this case too the operations that the user has to perform in order to ski downhill or uphill: in fact, in order to predispose the rear portion of the ski mountaineering binding (1) for descent, after having walked uphill, the user only has to rotate the turret (5, 6) to bring it into the first turret position (T1); in order to predispose the rear portion of the ski mountaineering binding (1) for the ascent, after having skied downhill, the user only has to rotate the turret to bring it into the second turret position.

The first abutting element (35) is preferably positioned at the bottom of the turret (5, 6) and projects inferiorly from the bottom of the turret (5, 6), so that a rotation of the first abutting element (35) corresponds to a rotation of the turret (5, 6).

The first abutting element (35) is preferably an abutment disc (35) which: is fixed to the bottom of the turret (5, 6), in such a way that the relative axis is parallel to the axis of the turret (5, 6); is peripherally provided with an annular gully (36) so as to contact the connecting element (31).

Figure 32:
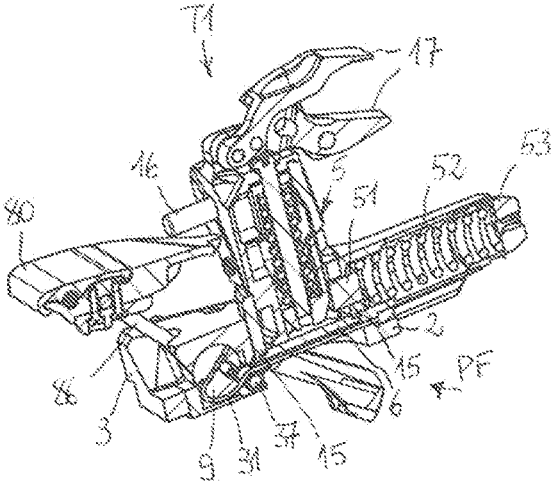
FIG. 32 is alike to FIG. 31, with the difference that it is an axonometric view.

The connecting element (31) is preferably a wire (see for example FIG. 32).

The connecting element (31) can have other shapes. For example, the connecting element (31) can be a strap, a tape, a chain, a plurality of wires intertwined with one another a plurality of sub-elements connected with one another (these variants are not illustrated).

The connecting means (31, 35, 37) preferably comprise a return member (37) which is interposed between the rotation member (9) and the first abutting element (35); the connecting element (31) partially winds about the return member (37).

Figure 37:
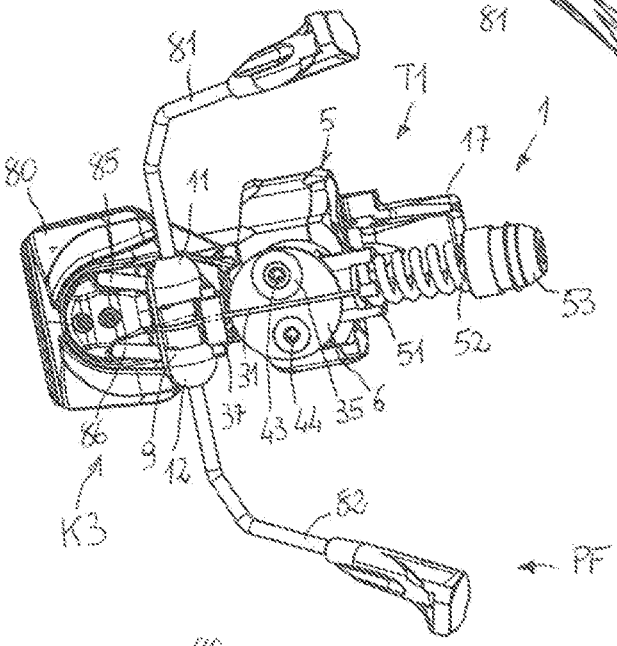
Figure 38:
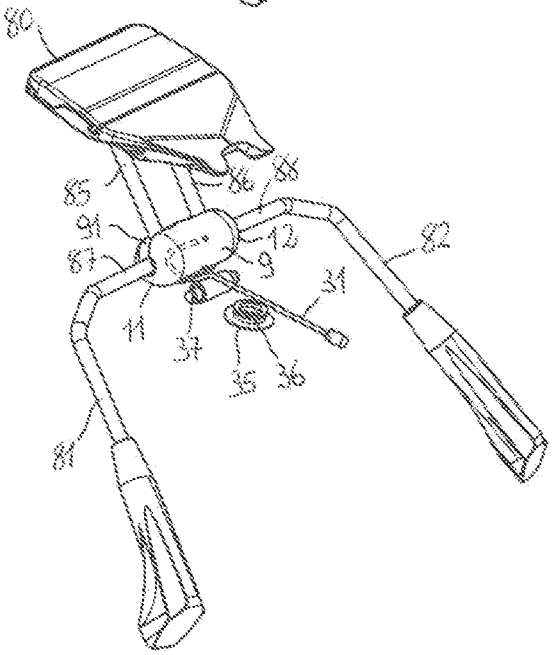
FIG. 38 is an axonometric view of detail K3 of FIG. 10.

The return member (37) is preferably a return roller, see for example FIGS. 37 and 38.

The return member (37) can be orientated with the axis thereof which is transversal, preferably perpendicular, to the axis of the ski (4) when the base (2, 3) is fixed to the ski (4). The return member (37) can be idle.

According to a third embodiment of the invention (FIGS. 53-58): the rotation member (9) is provided with a first arched cogging (21); the turret bears a first abutment (61); the connecting means (31, 32, 72) comprise a connecting element (31) which is movable by translation, and which comprises a second straight cogging (32) and a second abutment element (72); the connecting element (31) is coupled to the rotation member (9) by enmeshing of the relative second straight cogging (32) with the first arched cogging (21) so that a translating movement of the connecting element (31) determines a rotation of the rotation member (9), and vice versa; when the braking lever (8) is in the non-active position (PD) the turret (5, 6) can reach the second turret position (T2), so that the first abutment (61) abuts the second abutting element (72) preventing the braking lever (8) from being brought into the braking position (PF) due to the action of the first elastic means.

The first abutment (61) can have the shape of a portion of circular crown: in particular, the first abutment (61) can have an extension of less than half of a circular crown, as can be seen from the drawings.

The first arched cogging (21) is preferably made at the cylindrical portion of the rotation member (9).

The base (2, 3) is preferably provided with a guide (14) the connecting element (31) forms (see for example FIG. 10), or is provided with, a carriage (34) which is slidable along the guide (14).

The guide (14) can have an axis which is parallel to the axis of the ski (4) when the base (2, 3) is fixed to the ski (4), so that the connecting element (31) is movable parallel to the axis of the ski (4).

The second abutting element (72) and the second straight cogging (32) can be included on a same side of the connecting element (31), which side is facing towards the turret (5, 6); the second abutting element (72) can project with respect to the second straight cogging (32).

According to a fourth embodiment (FIGS. 59-64): the rotation member (9) is provided with a first arched cogging (21); the turret (5, 6) comprises a second abutment (62); the connecting means (31, 32, 73) comprise a connecting element (31) which is movable by translation, and which comprises a second straight cogging (32) and a third abutting element (73); the connecting element (31) is coupled to the rotation member (9) by enmeshing of the relative second straight cogging (32) with the first arched cogging (21) so that a translating movement of the connecting element (31) determines a rotation of the rotation member (9), and vice versa;

it comprises second elastic means (52) which are arranged to solicit the turret (5, 6); when the braking lever (8) is in the braking position (PF) the turret (5, 6) can rotate from the first turret position (T1) towards a third turret position (T3), which precedes the second turret position (T2), at which the second abutment (62) interferes with the third abutting element (73), thus preventing a further rotation of the turret (5, 6) to reach the second turret position (T2); the second elastic means (52) are configured in such a way that when the turret (5, 6) is in the third turret position (T3) the second elastic means (52) determine a third rotation torque on the turret (5, 6) which tends to bring the turret (5, 6) into the second turret position (T2) once the braking lever (8) is brought from the braking position (PF) into the non-active position (PD).

This advantageously simplifies in this case too the operations that the user has to perform in order to ski downhill or uphill: in fact, in order to predispose the rear portion of the ski mountaineering binding (1) for descent, after having walked uphill, the user only has to rotate the turret (5, 6) to bring it into the first turret position (T1); in order to predispose the rear portion of the ski mountaineering binding (1) for the ascent, after having skied downhill, the user must rotate the turret (5, 6), until it reaches the third turret position (T3), and then bring the braking lever (8) into the non-active position (PD), so that the second elastic means (52) successively cause the final rotation of the turret (5, 6) into the second turret position (T2).

The third turret position (T3) can be close to the second turret position (T2).

The third turret position (T3) can be closer to the second turret position (T2) than to the first turret position (T1).

The rear portion of a ski mountaineering binding (1) preferably comprises a pusher (51) which is moved by the second elastic means (52), while the turret (5, 6) comprises: a first seat (101) which is arranged to receive the pusher (51) when the turret (5, 6) is in the first turret position (T1), so that the action of the second elastic means (52) stabilises the turret (5, 6) in the first turret position (T1); a second seat (102) which is arranged to receive the pusher (51) when the turret (5, 6) is in the second turret position (T2), so that the action of the second elastic means (52) stabilises the turret (5, 6) in the second turret position (T2).

The first seating 101 is preferably recessed.

The second seat 102 is preferably recessed.

The turret (5, 6) and the second seat (102) are preferably conformed with respect to one another in such a way that when the turret (5, 6) is in the third turret position (T3) the pusher (51) only partially engages the second seat (102), generating, via the second elastic means (52), the third rotation torque.

For example, the second seat (102) can be recessed and the turret (5, 6) can have a cylindrical shape in proximity of the second seat (102), so that the third rotation torque is generated in the third turret position (T3). Other shapes of the turret (5, 6) and the second seat (102) can however be included.

The second abutment (62) can have the shape of a portion of circular crown: in particular, the second abutment (62) can have an extension comprised between 0.06 and 0.2 times the extension of a circular crown.

The first arched cogging (21) is preferably made at the cylindrical portion of the rotation member (9).

The base (2, 3) is preferably provided with a guide (14) the connecting element (31) forms (see for example FIG. 10), or is provided with, a carriage (34) which is slidable along the guide (14).

The guide (14) can have an axis which is parallel to the axis of the ski (4) when the base (2, 3) is fixed to the ski (4), so that the connecting element (31) is movable parallel to the axis of the ski (4).

The third abutting element (73) and the second straight cogging (32) can be included on a same side of the connecting element (31), which side is facing towards the turret (5, 6); the third abutting element (73) can project with respect to the second straight cogging (32).

There follow more general considerations, to be understood to be valid for all the embodiments described in the foregoing.

The base (2, 3) can comprise a first portion of base (2) and a second portion of base (3).

The first portion of base (2) can be fixed to the ski (4), directly (as shown in the figures, for example by means of four screws, not illustrated, which insert in a same number of through-holes which are clearly visible for example in FIG. 2) or indirectly via a further portion of base (2, 3) (not illustrated) also being a part of the base (2, 3). The second portion of base (3) can be fixed to the first portion of base (2), for example by means of a first screw (41) and a second screw (42) (see for example FIGS. 1 and 2).

The turret (5, 6) is preferably rotatably coupled to the base (2, 3), for example to the first portion of base (2).

Still more preferably, the turret (5, 6) is coupled in a revolute pair to the base (2, 3). In this matter, the turret (5, 6) can comprise two distinct parts that are fixable to one another, i.e. a main body (5), which emerges from the base (2, 3), and a fixing disc (6), which is inferiorly fixed to the main body (5), for example by means of a third screw (43) and a fourth screw (44), see for example FIG. 3. The fixing disk (6) can define the bottom of the turret (5, 6). The base (2, 3), for example the first portion of base (2), can comprise an abutment (15) (see for example FIG. 4) for peripherally abutting the fixing disc (6) and enabling the rotation of the assembly formed by the main body (5) and the fixing disk (6), i.e. of the turret (5, 6), with respect to the relative axis. The axis of the turret (5, 6) is preferably perpendicular to the ski (4) when the base (2, 3) is fixed to the ski (4).

With reference to the first embodiment, the cam (13) can be a part of the fixing disc (6).

With reference to the second embodiment, the abutment disk (35) can be fixed to the fixing disk (6), by the same third screw (43).

Figure 16:
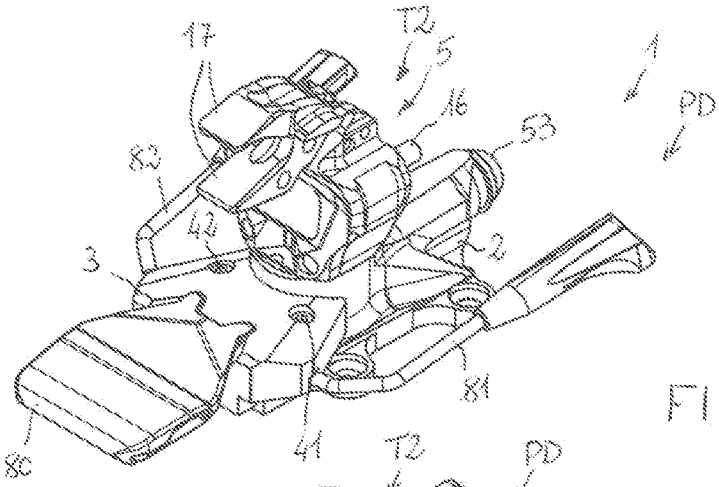
FIGS. 16, 17, 18 are respectively an axonometric view, in plan view and from below of the rear portion of a ski mountaineering binding according to a first embodiment of the invention, in a configuration in which the turret is in the second turret position for uphill walking and in which the braking lever is in the non-active position; the user can thus walk uphill.
Figure 20:
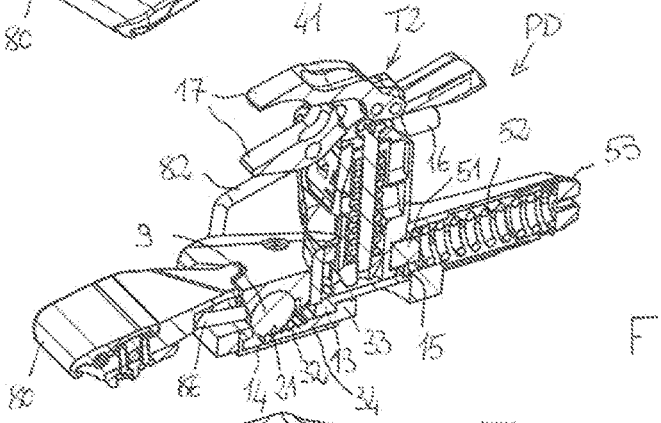
FIG. 20 is alike to FIG. 19, with the difference that it is an axonometric view.

The first turret position (T1) and the second turret position (T2) are preferably angularly distanced by 180 degrees (compare for example FIGS. 1 and 16).

The rear portion of a ski mountaineering binding (1) can comprise two pins (16). The pins (16) can be borne by the turret (5, 6) to hook the turret (5, 6) to the heel (7) of a ski boot for downhill skiing, see for example FIGS. 13, 15.

In the first turret position (T1) the pins (16) are preferably facing towards the front part of the ski (4) (see for example FIG. 1). Further, the pins (16) can be orientated parallel to the axis of the ski (4).

In the second turret position (T2) the pins (16) are preferably facing towards the rear part of the ski (4) (see for example FIG. 16). Further, the pins (16) can be orientated parallel to the axis of the ski (4).

Figure 19:
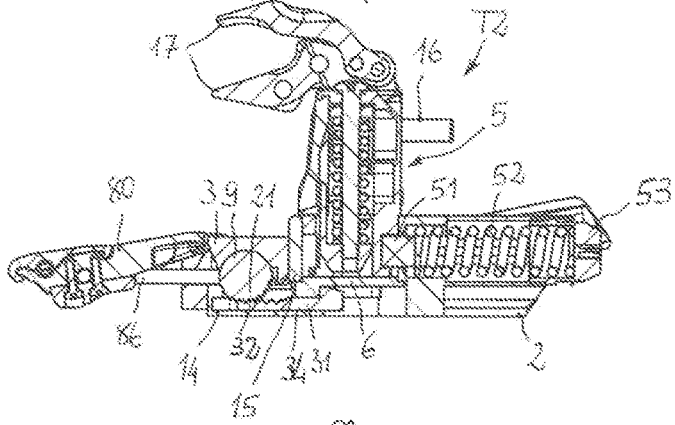
FIG. 19 is a view of section XIX-XIX of FIG. 17.
Figure 17:
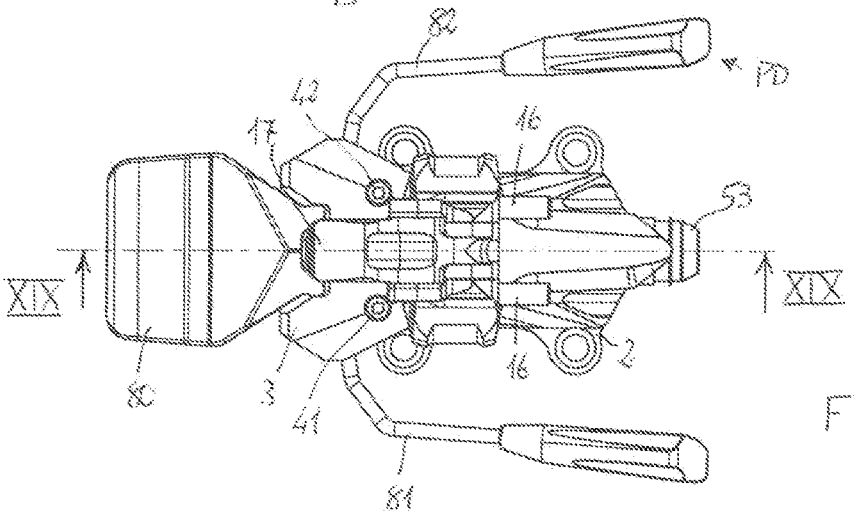
Figure 18:
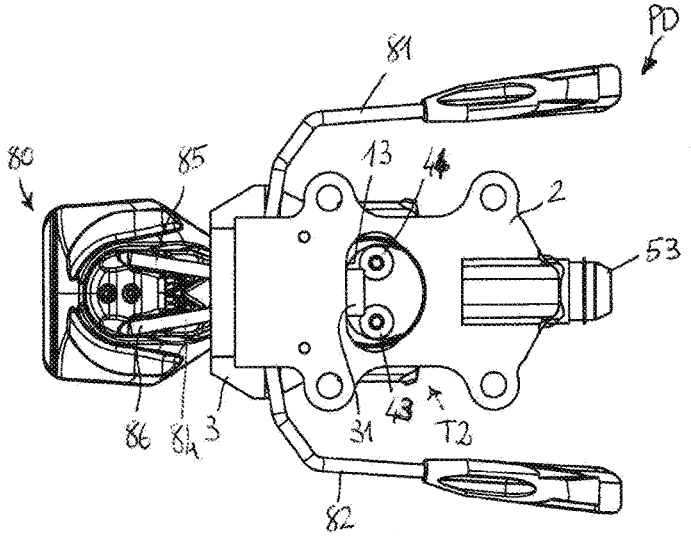
Figure 21:
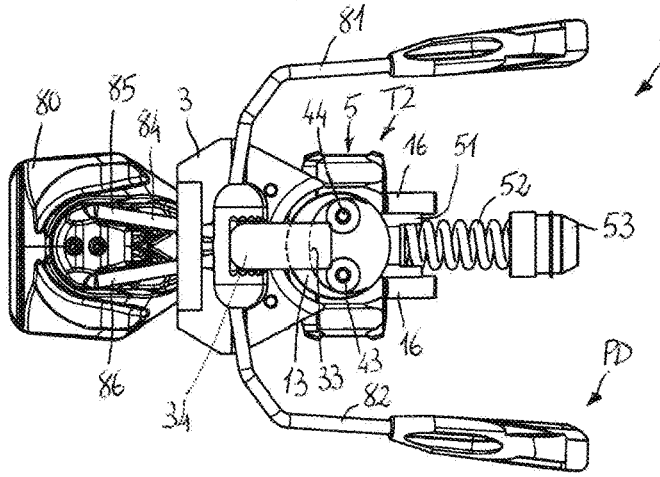
FIGS. 21, 22 are respectively a view from below in a lateral view of the rear portion of a ski mountaineering binding of FIGS. 16-18 in which the first portion of base has been removed.
Figure 22:
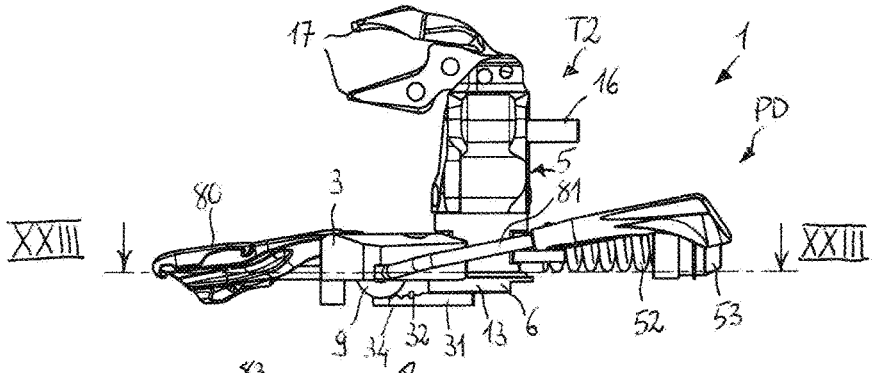

The rear portion of a ski mountaineering binding (1) can comprise one or more heel lifters (17) (the figures illustrate two heel lifters (17)), so as to offer to each one a support for the heel (7) of a ski boot for walking uphill (see FIG. 19, for example). At least one of the heel lifters (17) (the higher in the view of FIG. 19) can be rotatable.

As already explained for the fourth embodiment, the rear portion of the ski mountaineering binding (1) can comprise regulating means (51, 52, 53) for stabilising the turret (5, 6) when in the first turret position (T1) and the second turret position (T2), so that passing from the first turret position (T1) to the second turret position (T2), or vice versa, requires the application of at least a predetermined rotation torque on the turret (5, 6). The regulating means (51, 52, 53) can comprise: a pusher (51) for contacting the lateral wall of the turret (5, 6) (for example the main body (5)); second elastic means (52), for example a spring, which are interposed between the pusher (51) and the base (2, 3) (for example the first portion of base (2)) in such a way that when the pusher (51) is always in contact against the turret (5, 6); an adjustment screw (53) for adjusting the tension of the second elastic means (52) and thus the torque necessary for rotating the turret (5, 6) between the first turret position (T1) and the second turret position (T2).

The first elastic means can be defined by the coupling between the braking lever (8) and the base (2, 3) (for example the second portion of base (3)) and therefore not be visible, as in the case illustrated in the figures (indeed no numerical reference is associated thereto). Alternatively, the first elastic means can also comprise one or more torque springs anchored to the base (2, 3) (for example the second portion of base (3); solution not illustrated).

Preferably, when the braking lever (8) is in the non-active position (PD), it does not brake the ski (4).

The brake (8, 81, 82, 83, 84, 85, 86, 87, 88, 89) preferably comprises a plate (80) for abutting (FIG. 15) the sole of the heel (7) of a ski boot. The plate (80) can be connected to an end of the activation arm (84), for example rotatably. The plate (80) can be anchored (see for example FIG. 23) to a connecting member (89) which in turn connects the first prong (85) to the second prong (86).

There follows a description of the functioning of the rear portion of a ski mountaineering binding (1), according to the first embodiment.

FIGS. 1-12 show the rear portion of the ski mountaineering binding (1) in a configuration in which when the turret (5, 6) is in the first turret position (T1) for skiing downhill and the braking lever (8) is in the braking position (PF).

Figure 13:
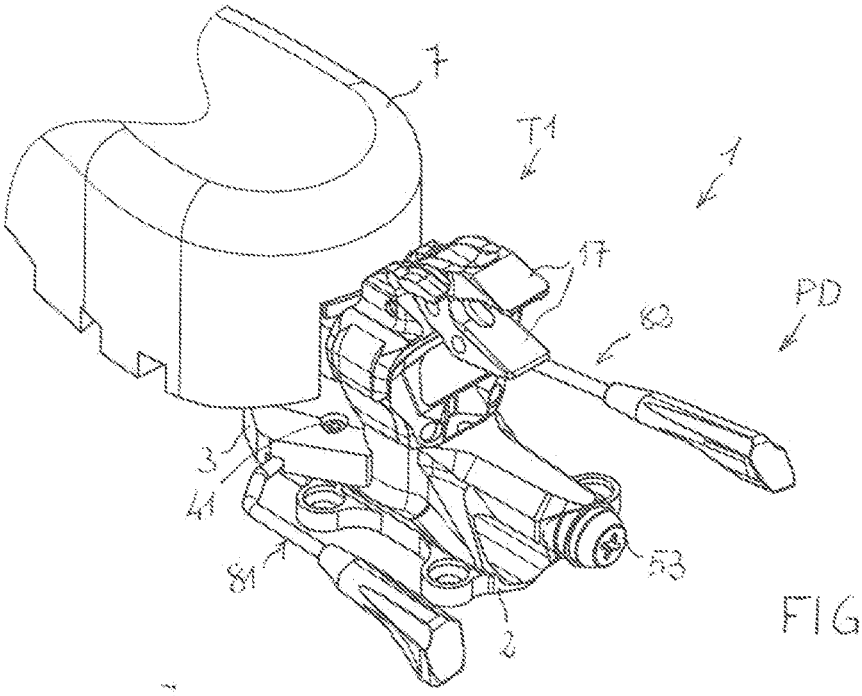
FIGS. 13, 14 are respectively an axonometric view and a plan view of the rear portion of a ski mountaineering binding, according to a first embodiment of the invention, and of a heel of the ski boot for ski mountaineering hooked to the turret, in a configuration in which the turret is in the first turret position in which the braking lever has reached a non-active position after the heel of the ski boot has been hooked to the turret; the user can thus ski downhill.
Figure 14:
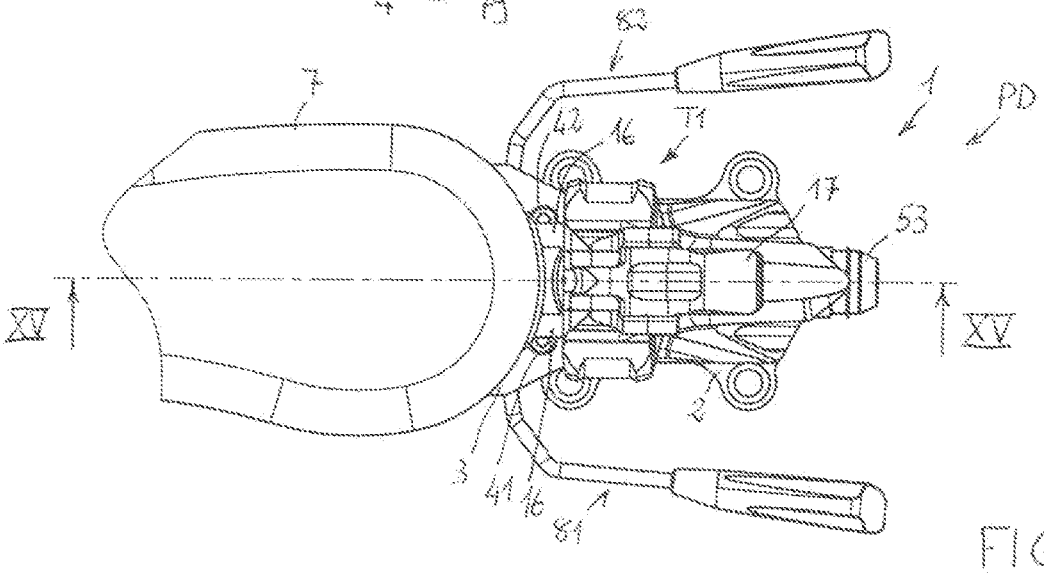

To ski downhill, FIGS. 13-15, it is necessary to press the heel (7) of the ski boot on the plate (80), in such a way that the heel (7) of a ski boot hooks to the turret (5, 6) by means of the pins (16). The pressure thus exerted on the plate (80) brings the braking lever (8) into the non-active position (PD), against the action of the first elastic means, so that the first brake arm (81) and the second brake arm (82) lift, so as to be above the rest surface (79) of the ski (4). It is thus possible to ski downhill. It is worthy of note that the rotation of the braking lever (8) determines in turn the corresponding rotation of the rotation member (9) (in a counter-clockwise direction observing FIG. 4), which in turn determines the retraction (displacement right-wards in FIG. 4) of the connecting element (31) towards the axis of the turret (5, 6) (compare FIGS. 4 and 15 to one another).

Instead, in order to ski uphill it is necessary to unhook the heel (7) of the ski boot from the pins (16) borne by the turret (5, 6), so that the rear portion of a ski mountaineering binding (1) returns into the configuration illustrated in FIGS. 1-12: in this case, as the pressure of the heel (7) of the ski boot on the plate (80) is removed, the first elastic means bring the braking lever (8) newly into the braking position (PF), which determines a rotation of the rotation member (9) (in clockwise direction in FIG. 15), which in turn determines the advancement (i.e. the displacement left-wards in FIG. 15) of the connecting element (31) towards the tip of the ski (4) (away from the axis of the turret (5, 6)). Thereafter, the turret (5, 6) must be rotated into the second turret position (T2), FIGS. 16-27. With the rotation of the turret (5, 6), the cam (13) engages with the cam follower (33) of the connecting element (31), causing the retraction (i.e. displacement right-wards in FIG. 4) of the connecting element (31), the with a consequent rotation of the rotation member (9) (in a counter-clockwise direction observing FIG. 4), which in turn determines the rotation of the braking lever (8) into the non-active position (PD), with a consequent raising of the first brake arm (81) and of the second brake arm (82), so as to be above the rest surface (79) of the ski (4).

It is thus possible to walk uphill, for example by resting the heel (7) of the ski boot on one of the heel lifters (17).

To return to the configuration illustrated in FIGS. 1-12, it is sufficient to rotate the turret (5, 6) into the first turret position (T1): consequently, the cam (13) disengages from the cam follower (33) and the first elastic means determine the rotation of the braking lever (8) into the braking position (PF).

The braking lever (8) can oscillate by about 40-60 degrees between the braking position (PF) and the non-active position (PD).

There follows a description of the functioning of the rear portion of a ski mountaineering binding (1), according to the second embodiment.

FIGS. 28-38 show the rear portion of a ski mountaineering binding (1) in a configuration in which the turret (5, 6) is in the first turret position (T1) for skiing downhill and the braking lever (8) is in the braking position (PF).

Figure 39:
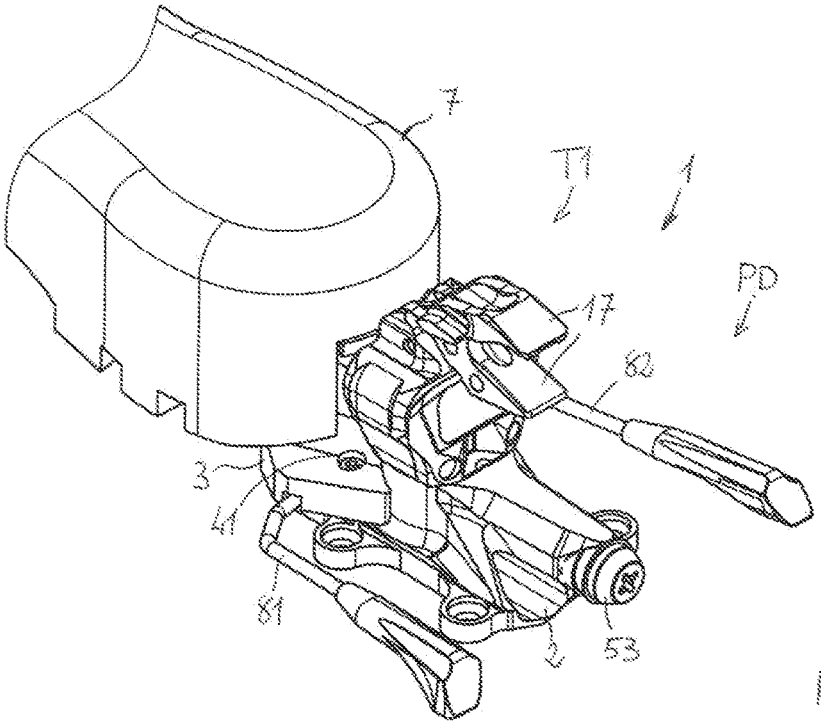
FIGS. 39, 40 are respectively an axonometric view and a plan view of the rear portion of a ski mountaineering binding, according to a second embodiment of the invention, and of a heel of the ski boot for ski mountaineering hooked to the turret, in a configuration in which the turret is in the first turret position in which the braking lever has reached a non-active position after the heel of the ski boot has been hooked to the turret; the user can thus ski downhill.
Figure 41:
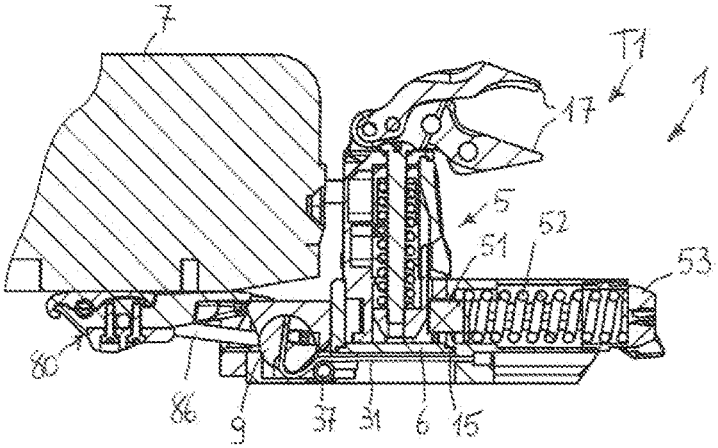
FIG. 41 is a view of section XXXXI-XXXXI of FIG. 40.
Figure 40:
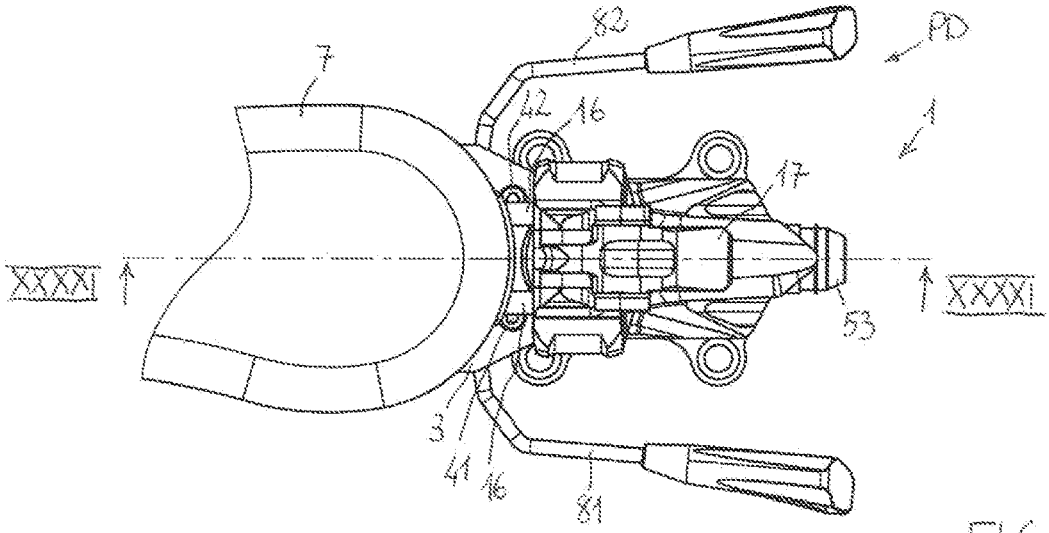
Figure 42:
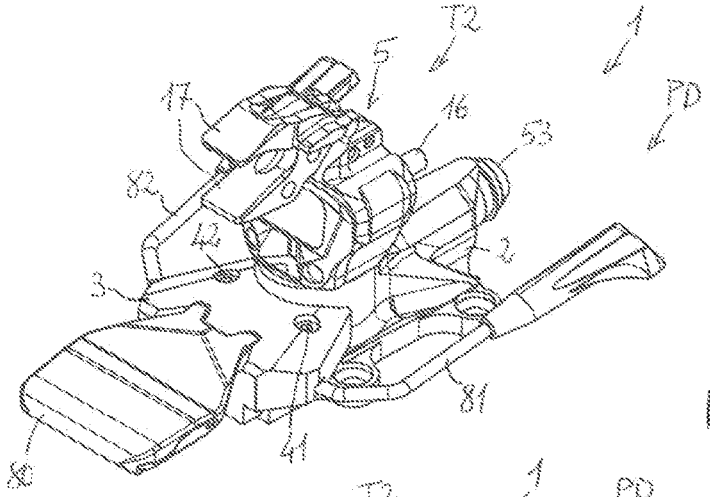
FIGS. 42, 43, 44 are respectively an axonometric view, in plan view and from below of a rear portion of a ski mountaineering binding according to a second embodiment of the invention, in a configuration in which the turret is in the second turret position for uphill walking and in which the braking lever is in the non-active position; the user can thus walk uphill.
Figure 46:
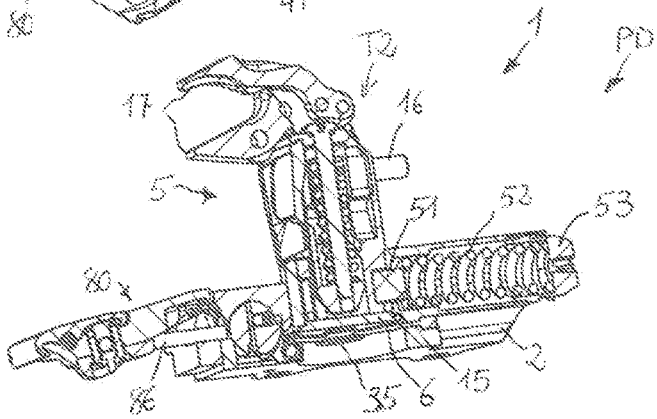
FIG. 46 is alike to FIG. 45, with the difference that it is an axonometric view.
Figure 45:
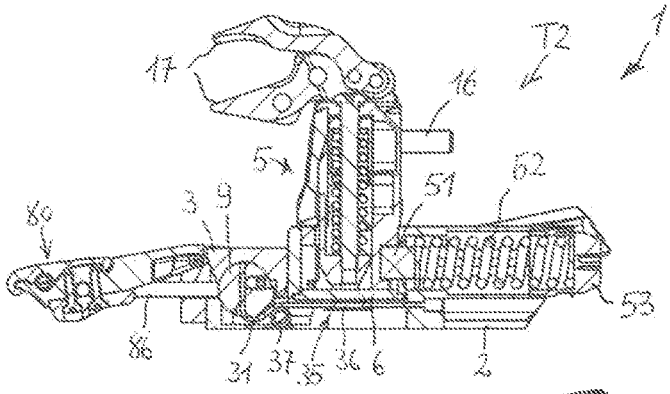
FIG. 45 is a view of section XXXXV-XXXXV of FIG. 43.
Figure 43:
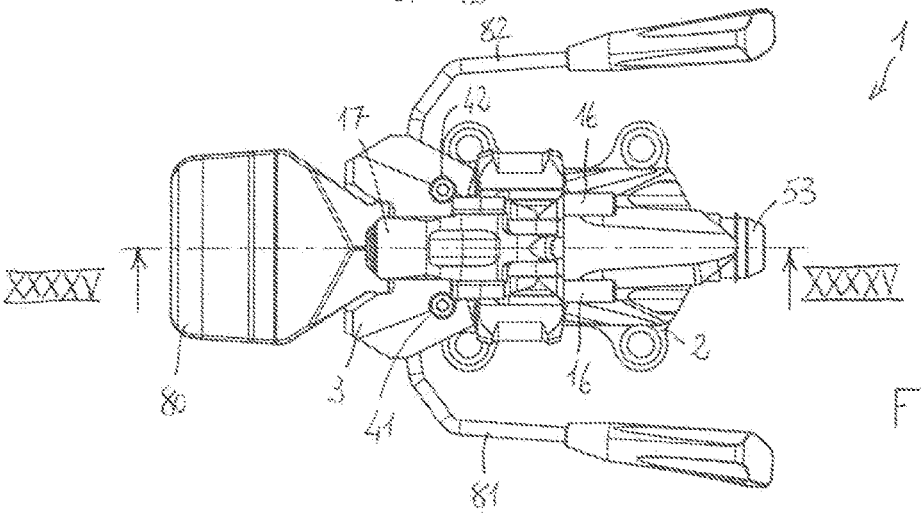
Figure 44:
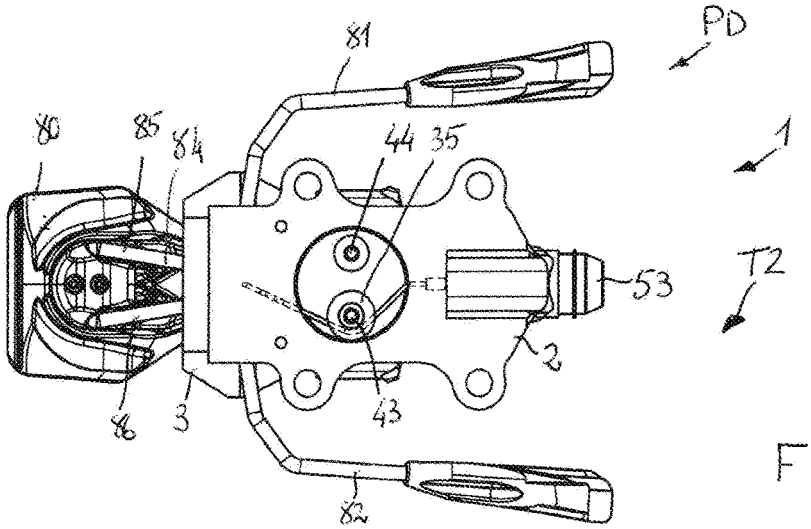
Figure 47:
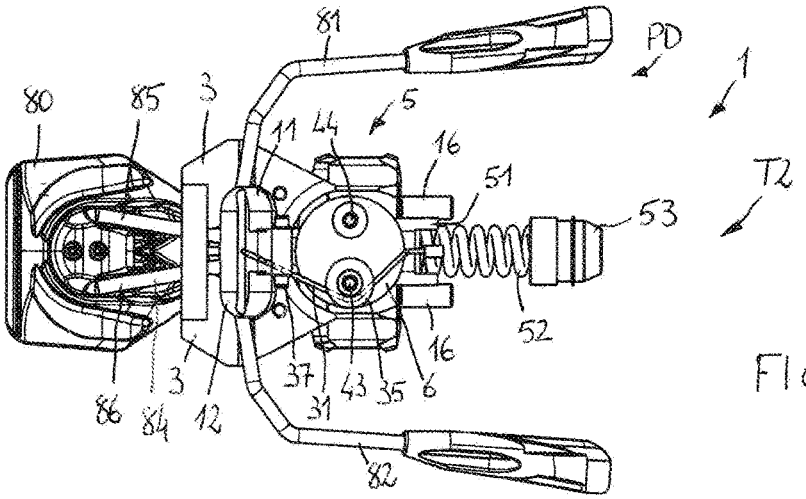
FIGS. 47, 48 are respectively a view from below and a lateral view of the rear portion of the ski mountaineering binding of FIGS. 42-44 in which a first portion of base has been removed.
Figure 48:
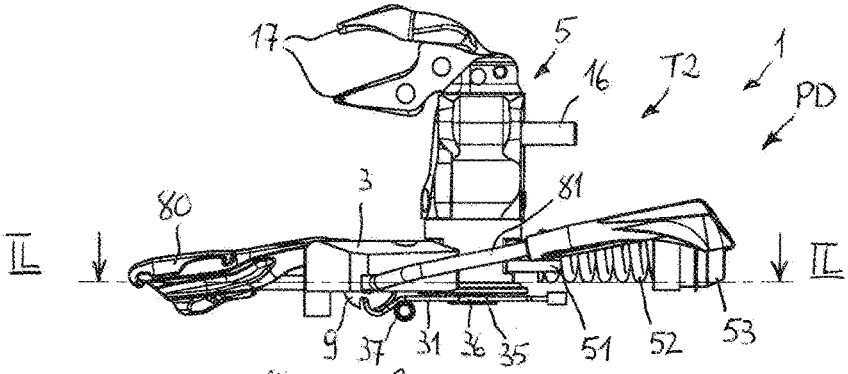
Figure 49:
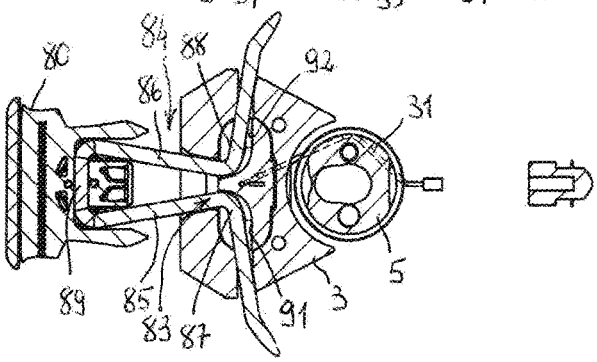
FIG. 49 is a view according to section plane XXXV-XXXV of FIG. 48.

To ski downhill, FIGS. 39-41, it is necessary to press the heel (7) of the ski boot on the plate (80), in such a way that the heel (7) of a ski boot hooks to the turret (5, 6) by means of the pins (16). The pressure thus exerted on the plate (80) brings the braking lever (8) into the non-active position (PD), against the action of the first elastic means, so that the first brake arm (81) and the second brake arm (82) lift, so as to be above the rest surface (79) of the ski (4). It is thus possible to ski downhill. It is worthy of note that the rotation of the braking lever (8) determines in turn the corresponding rotation of the rotation member (9) (in a counter-clockwise direction observing FIG. 31), which in turn determines the partial unwinding of the wire from the rotation member (9).

Figure 31:
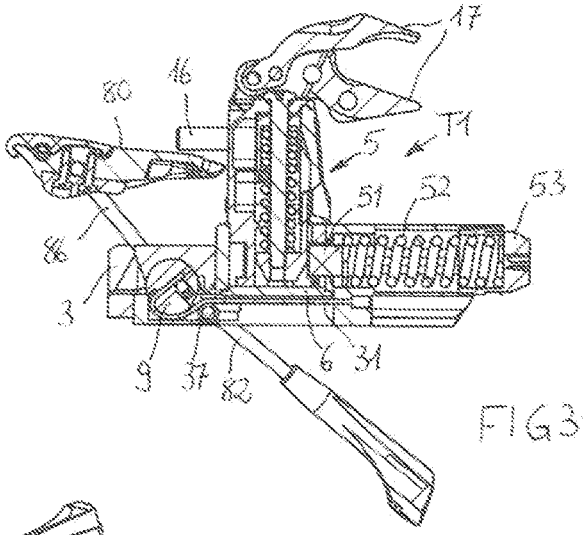
FIG. 31 is a view of section XXXI-XXXI of FIG. 29.
Figure 29:
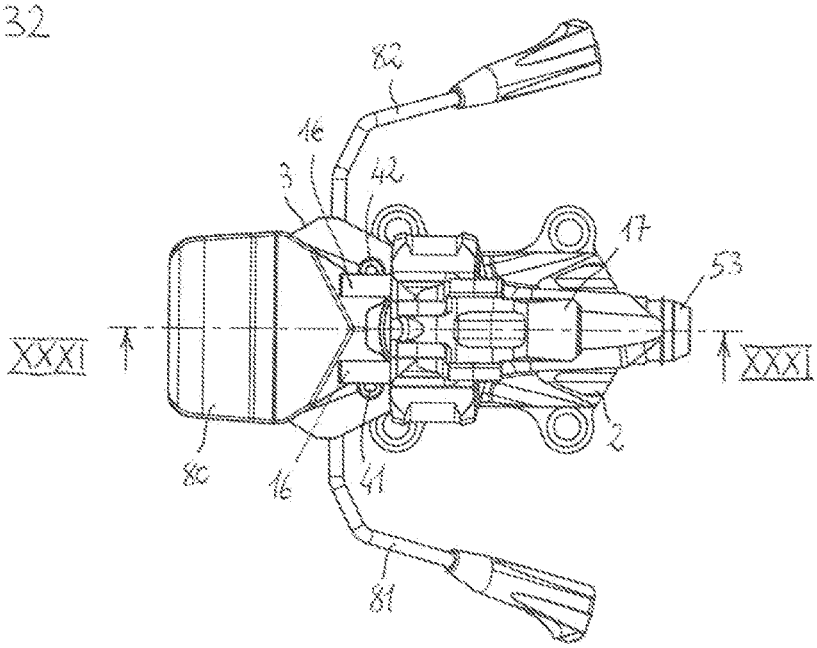
Figure 30:
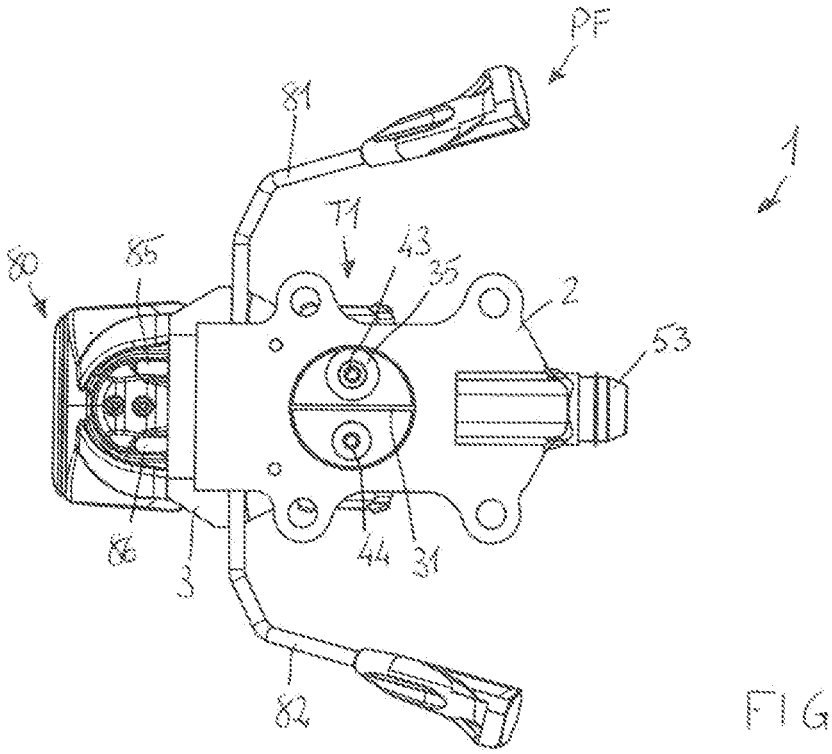
Figure 33:
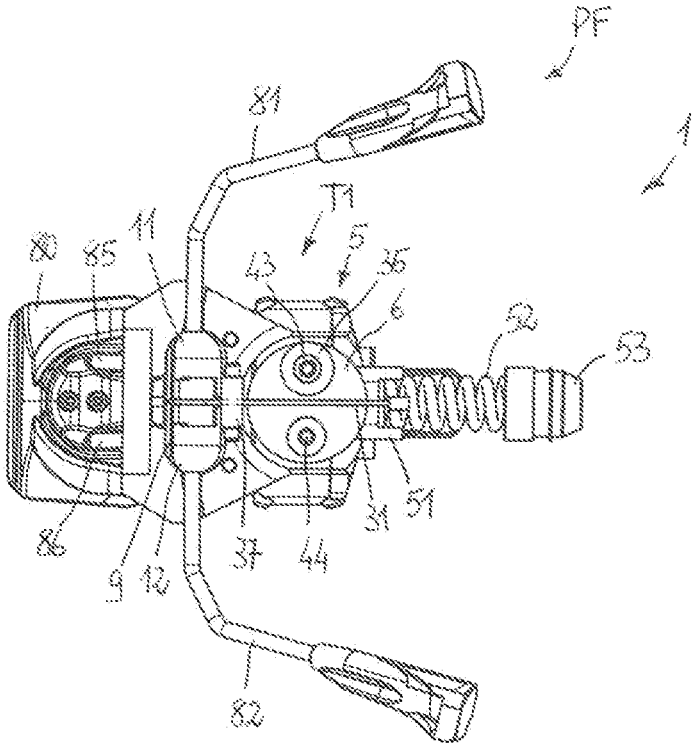
FIGS. 33, 34 are respectively a view from below and a lateral view of the rear portion of the ski mountaineering binding of FIGS. 28-30 in which a first portion of base has been removed.
Figure 34:
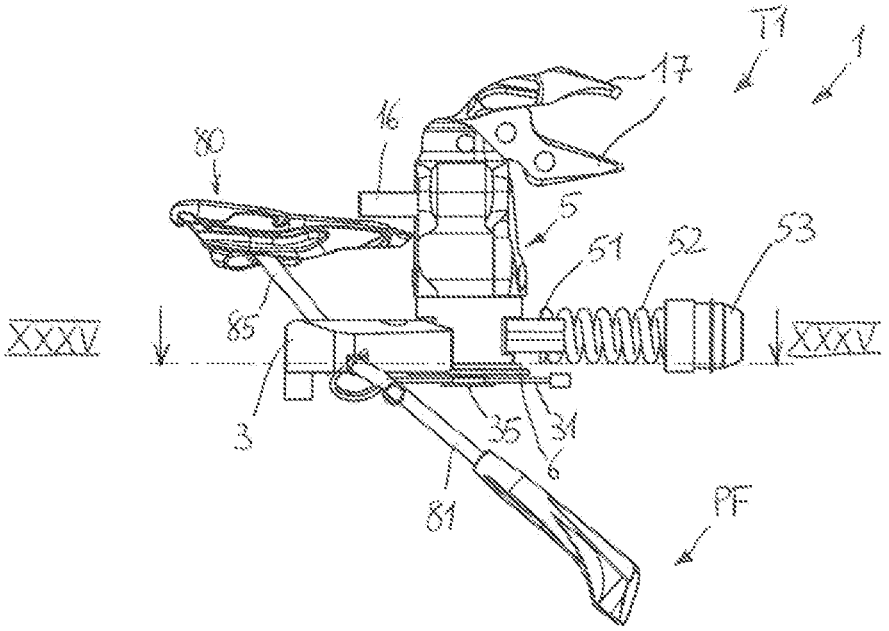
Figure 35:
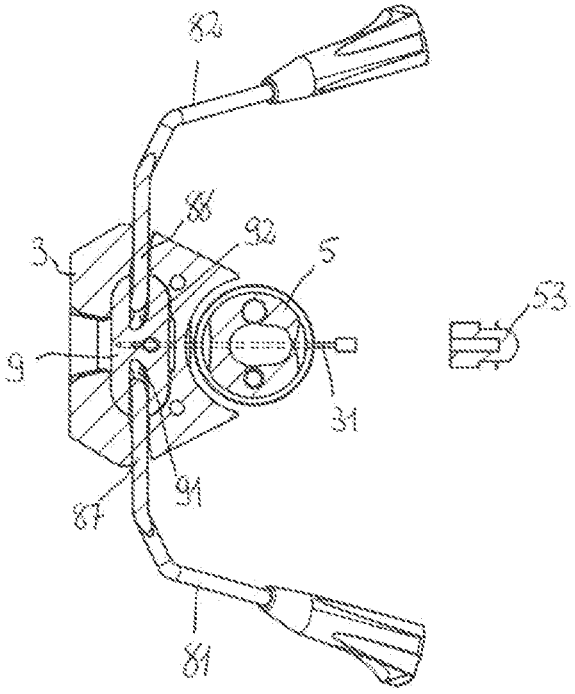
FIG. 35 is a view according to section plane XXXV-XXXV of FIG. 34.

Instead, in order to ski uphill it is necessary to unhook the heel (7) of the ski boot from the pins (16) borne by the turret (5, 6), so that the rear portion of a ski mountaineering binding (1) returns into the configuration illustrated in FIGS. 28-38: in this case, as the pressure of the heel (7) of the ski boot on the plate (80) is removed, the first elastic means bring the braking lever (8) newly into the braking position (PF), which determines a rotation of the rotation member (9) (in clockwise direction in FIG. 31), which in turn determines the partial winding of the wire about the rotation member (9) (see FIG. 31, for example).

Thereafter, the turret (5, 6) must be rotated into the second turret position (T2), FIGS. 42-52.

With the rotation of the turret (5, 6) the fixing disk (6) also rotates and abuts the wire (see for example FIG. 47), provoking a rotation of the rotation member (9) (in a counter-clockwise direction observing FIG. 31), which in turn determines the rotation of the braking lever (8) into the non-active position (PD), with a consequent raising of the first brake arm (81) and of the second brake arm (82), so as to be above the rest surface (79) of the ski (4).

It is thus possible to walk uphill, for example by resting the heel (7) of the ski boot on one of the heel lifters (17).

To return to the configuration illustrated in FIGS. 28-38, it is sufficient to rotate the turret (5, 6) into the first turret position (T1): consequently, the fixing disk (6) disengages from the wire and the first elastic means determine the rotation of the braking lever (8) into the braking position (PF).

The braking lever (8) can oscillate by about 40-60 degrees between the braking position (PF) and the non-active position (PD).

There follows a description of the functioning of the rear portion of a ski mountaineering binding (1), according to the third embodiment.

Figure 53:
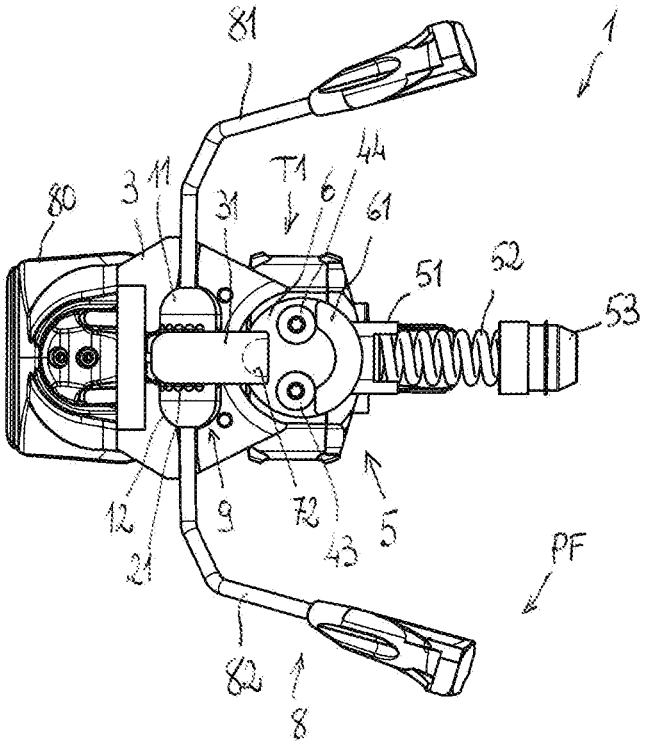
FIGS. 53, 54 are respectively a view from below and in an axonometric view from below of a rear portion of a ski mountaineering binding according to a third embodiment of the invention, in a configuration in which a relative turret is in the first turret position for downhill skiing, in which a braking lever of a relative brake is in a braking position and in which the relative base has been removed (FIG. 54) or a portion of the base (FIG. 53)
Figure 54:
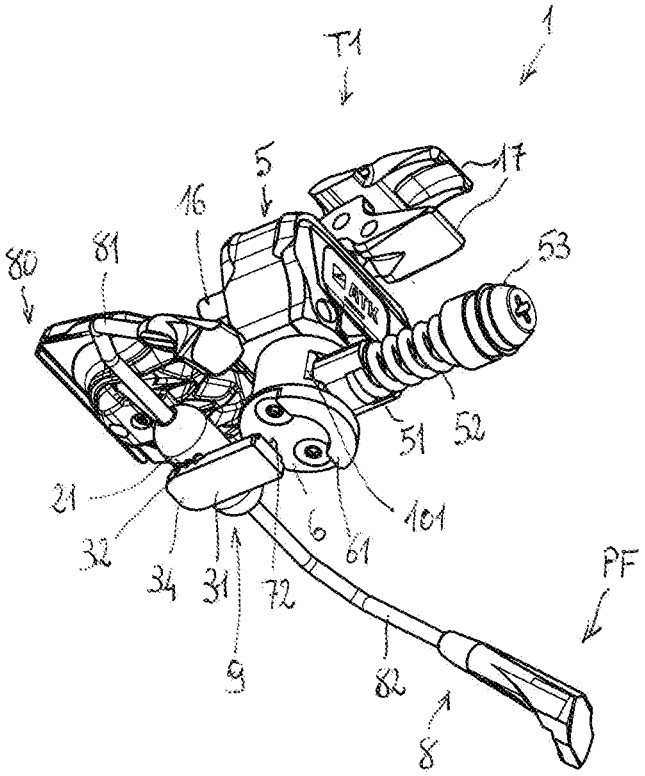
Figure 55:
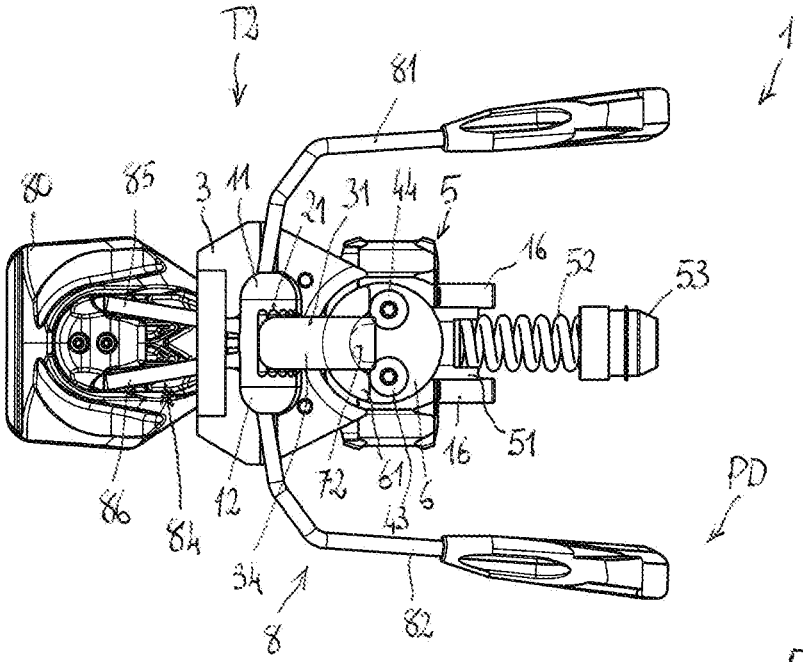
FIGS. 55, 56 are respectively a view from below and in an axonometric view from below of a rear portion of a ski mountaineering binding, according to a third embodiment, in a configuration in which the turret is in the second turret position for uphill walking and in which the braking lever is in a non-active position; the user can thus walk uphill.
Figure 56:
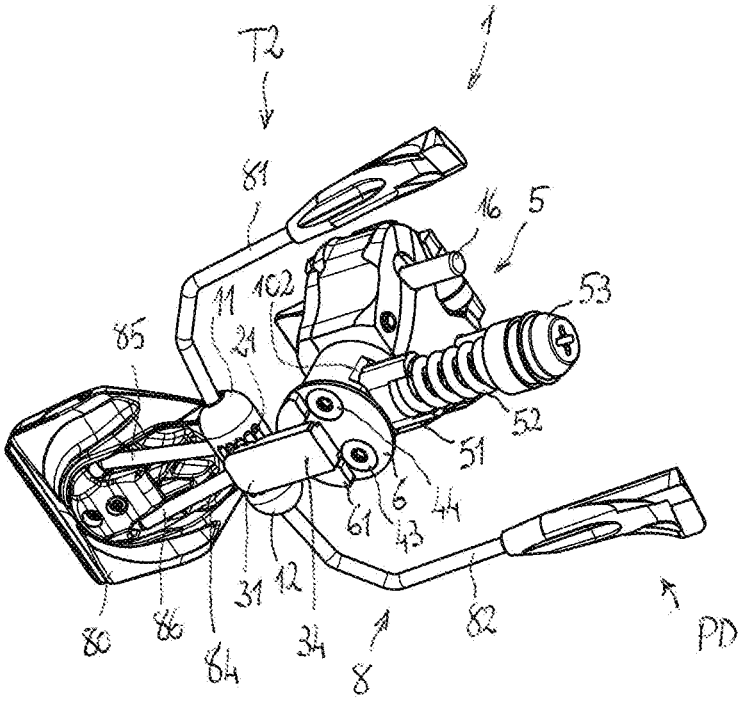

FIGS. 53-54 show the rear portion of a ski mountaineering binding (1) in a configuration in which the turret (5, 6) is in the first turret position (T1) for skiing downhill and the braking lever (8) is in the braking position (PF).

To ski downhill the same considerations as above are to be followed with reference to the functioning of the rear portion of the ski mountaineering binding (1) according to the first embodiment.

In order to ski uphill it is necessary to unhook the heel (7) of the ski boot from the pins (16) borne by the turret (5, 6), so that the rear portion of a ski mountaineering binding (1) returns into the configuration illustrated in FIGS. 53-54. Thereafter, the following actions can be carried out contemporaneously (FIGS. 55-56): the plate (80) is pressed manually, so as to bring the braking lever (8) into the non-active position (PD); and the turret (5, 6) rotates into the second turret position (T2), so that the first abutment (61) abuts the second abutting element (72). In this way, the connecting element (31) is prevented from translating and the braking lever (8) remains stably in the non-active position (PD) notwithstanding the action that the first elastic means exert on the braking lever (8), and, therefore, on the rotation member (9) and on the connecting element (31).

Figure 57:
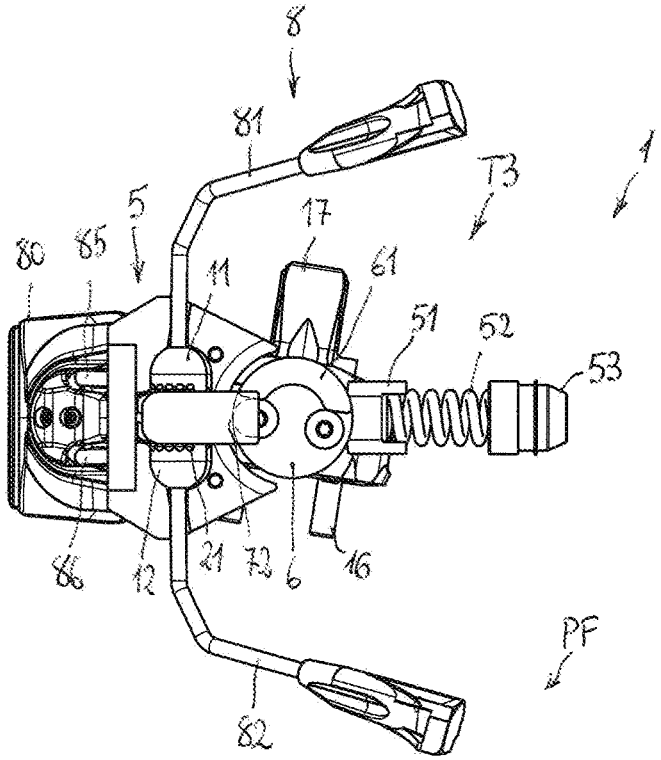
FIGS. 57, 58 are respectively a view from below and in an axonometric view from below of a rear portion of a ski mountaineering binding, according to a third embodiment, in a configuration in which the turret is in the third turret position and in which the braking lever is in the braking position.
Figure 58:
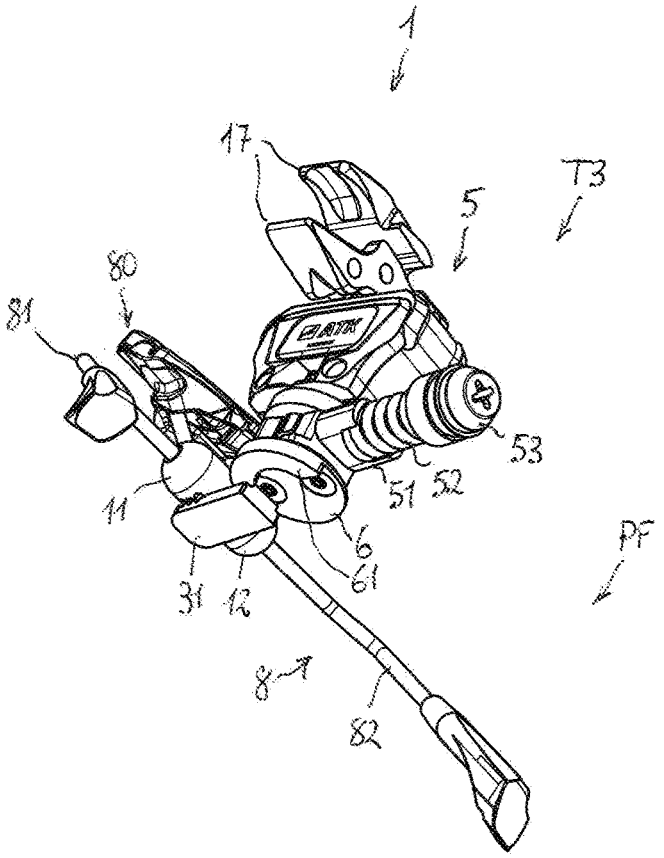

If during the rotation of the turret (5, 6,) the braking lever (8) is not brought into the non-active position (PD), the first abutment (61) collides with the second abutting element (72), which prevents the turret (5, 6) from reaching the second turret position (T2); see FIGS. 57-58.

There follows a description of the functioning of the rear portion of a ski mountaineering binding (1), according to the fourth embodiment.

Figure 59:
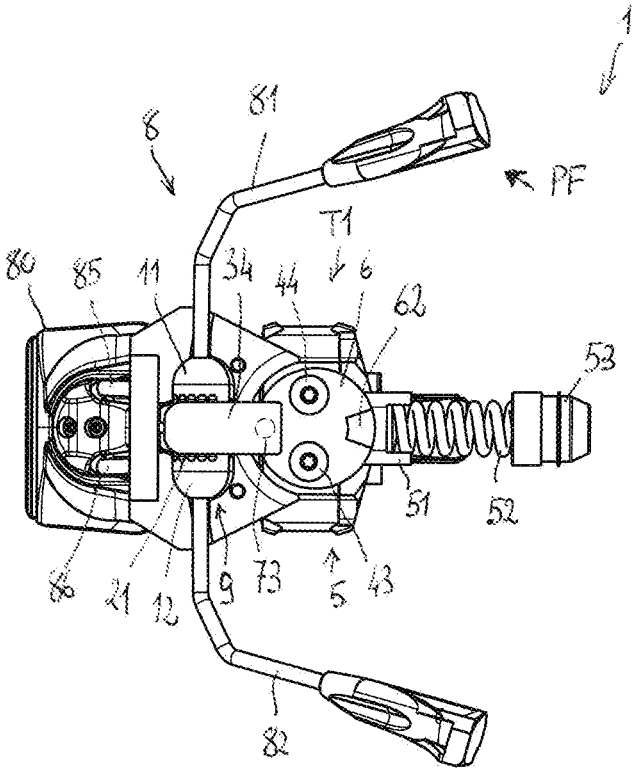
FIGS. 59, 60 are respectively a view from below and in an axonometric view from below of a rear portion of a ski mountaineering binding according to a fourth embodiment, in a configuration in which a relative turret is in the first turret position for downhill skiing, in which a braking lever of a relative brake is in a braking position and in which the relative base has been removed (FIG. 60) or a portion of the base (FIG. 59)
Figure 60:
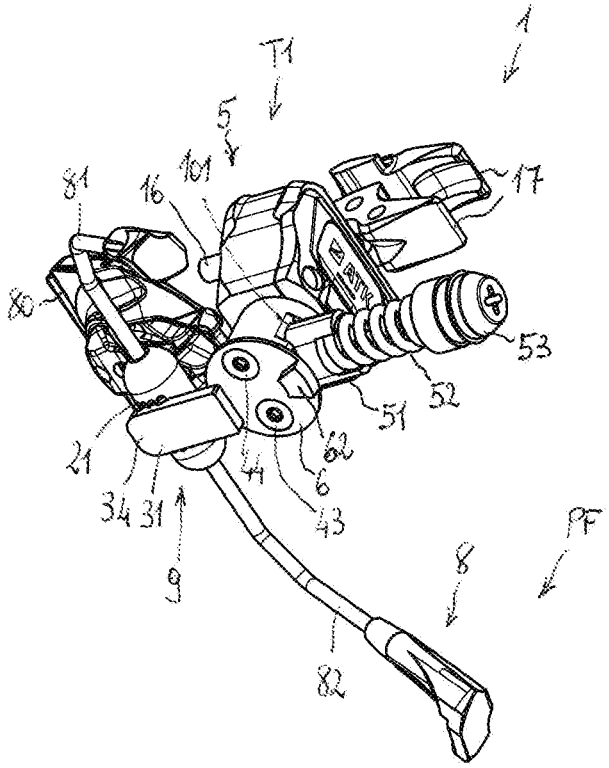
Figure 61:
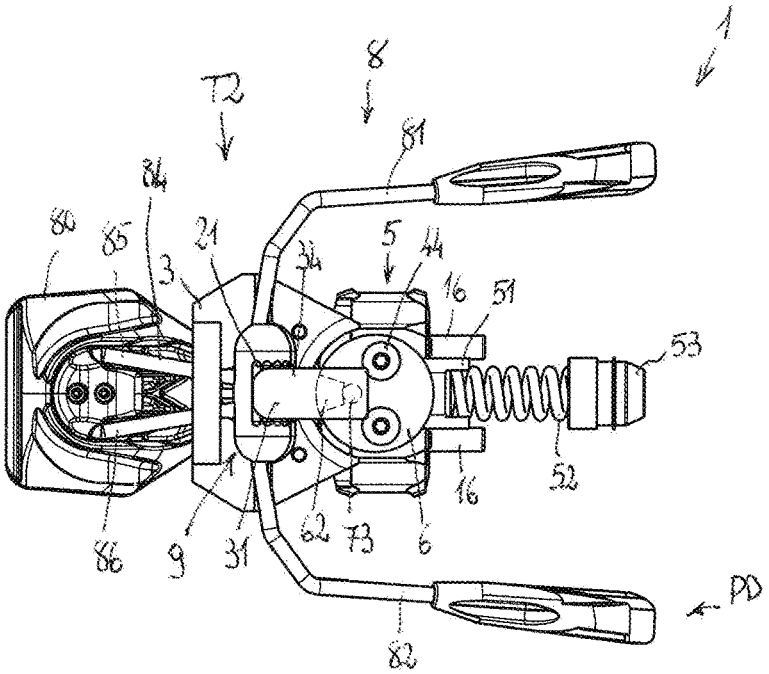
FIGS. 61, 62 are respectively a view from below and in an axonometric view from below of a rear portion of a ski mountaineering binding, according to the fourth embodiment, in a configuration in which the turret is in the second turret position for uphill walking and in which the braking lever is in a non-active position; the user can thus walk uphill.
Figure 62:
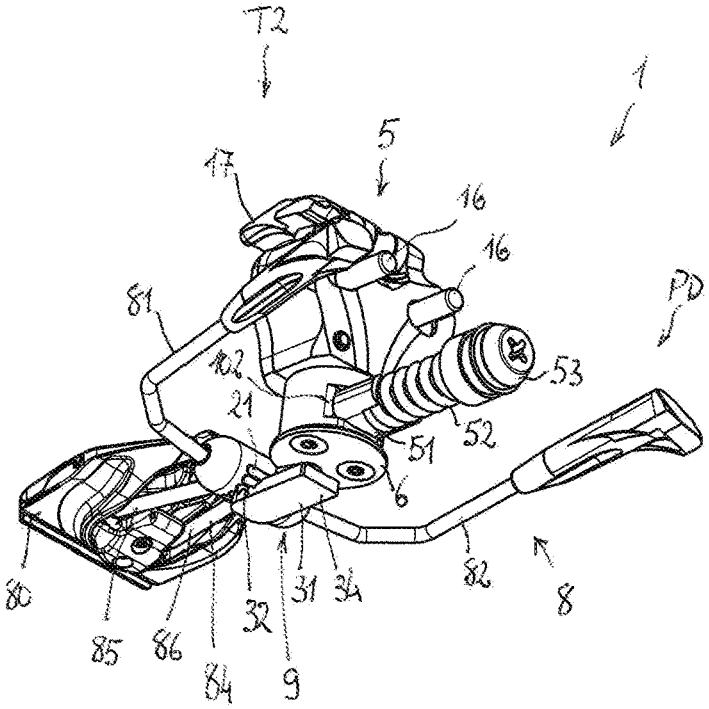

FIGS. 59-60 show the rear portion of a ski mountaineering binding (1) in a configuration in which the turret (5, 6) is in the first turret position (T1) for skiing downhill and the braking lever (8) is in the braking position (PF).

To ski downhill the same considerations as above are to be followed with reference to the functioning of the rear portion of the ski mountaineering binding (1) according to the first embodiment.

In order to ski uphill it is necessary to unhook the heel (7) of the ski boot from the pins (16) borne by the turret (5, 6), so that the rear portion of a ski mountaineering binding (1) returns into the configuration illustrated in FIGS. 59-60. Thereafter, the following actions can be carried out contemporaneously (FIGS. 61-62): the plate (80) is pressed manually), so as to bring the braking lever (8) into the non-active position (PD); and the turret (5, 6) rotates into the second turret position (T2), so that the second abutment (62) abuts the third abutting element (73). In this way, the connecting element (31) is prevented from translating and the braking lever (8) remains stably in the non-active position (PD) notwithstanding the action that the first elastic means exert on the braking lever (8), and, therefore, on the rotation member (9) and on the connecting element (31).

Figure 63:
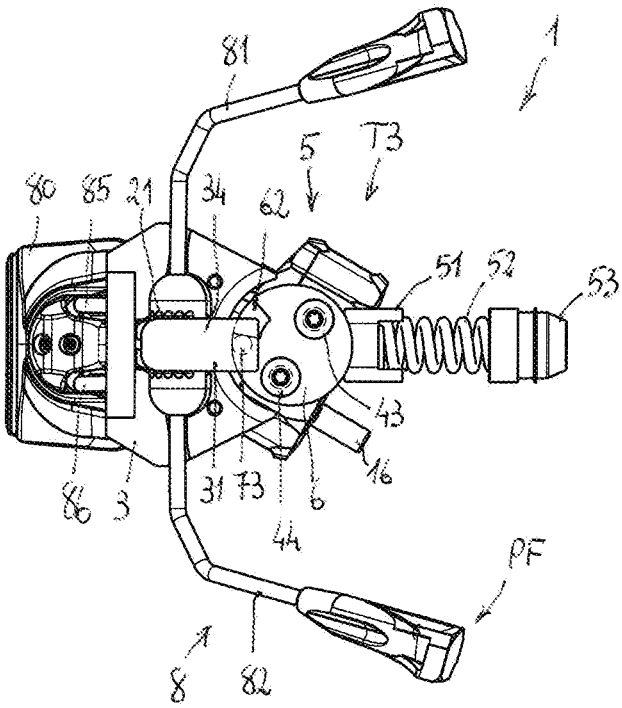
FIGS. 63, 64 are respectively a view from below and in an axonometric view from below of a rear portion of a ski mountaineering binding, according to the fourth embodiment, in a configuration in which the turret is in the third turret position and in which the braking lever is in the braking position.
Figure 64:
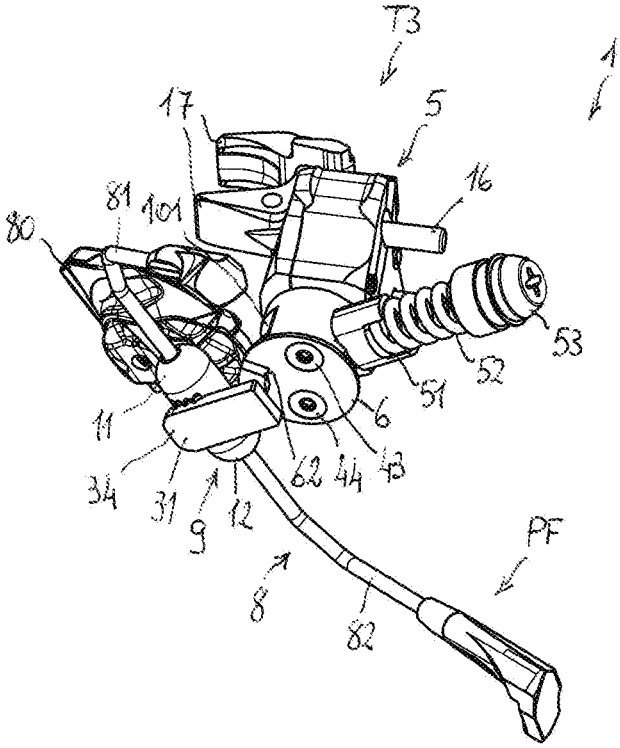

Alternatively, it is possible to carry out the following operations, one following another: the turret (5, 6) rotates up to the third turret position (T3), at which the second abutment (62) collides against the third abutting element (73), FIGS. 63-64, thus preventing a further rotation of the turret (5, 6) to reach the second turret position (T2); and the plate (80) is pressed, bringing the braking lever (8) into the non-active position (PD). At this point the second elastic means (52) cause a further rotation of the turret (5, 6) into the second turret position (T2), due to the generation of a third rotation torque.

This advantageously simplifies the operations that the user has to perform in order to ski uphill, with respect to the third embodiment of the invention: in fact it is not necessary to rotate the turret (5, 6) into the second turret position (T2) and, contemporaneously, press the plate (80), but it is sufficient to rotate the turret (5, 6) as far as possible and, thereafter, press the plate (80).

It is understood that the above has been described by way of non-limiting example and that any technical-functional variants are considered to fall within the protective scope of the present technical solution, as claimed in the following.

The invention claimed is:

1. A rear portion of a ski mountaineering binding, comprising:

a base which is fixable to a ski;

a turret which is borne by the base and which is rotatable with respect to the base in order to assume a first turret position, wherein it is fixable to the heel of a ski boot, so that it is possible to ski downhill, and in order to assume a second turret position, wherein it is not fixable to the heel of a ski boot, so that it is possible to walk uphill;

a brake for a ski;

wherein:

the brake comprises a braking lever which is rotatable to assume a braking position, in which it can brake a ski when the base is fixed to the ski, and a non-active position, in which it is non-active;

the brake comprises first elastic means for rotating the braking lever towards the braking position;

the braking lever is arranged so as to be pressable by the heel of the ski boot, when the base is fixed to the ski and the turret is in the first turret position, in order to reach the non-active position against the action of the first elastic means;

further comprising:

a rotation member which is rotatingly borne by the base and which in turn bears the braking lever so that a rotation of the rotation member corresponds to a rotation of the braking lever, and vice versa;

connecting means which connect the rotation member and the turret to one another, in such a way that the rotation member and the turret are solidly constrained to one another, when the turret is in the second turret position and when the braking lever is in the non-active position, so that it is possible to walk uphill; and wherein the rotation member and the braking lever are solidly constrained to one another.

2. The rear portion of a ski mountaineering binding of claim 1, wherein:

the rotation member comprises a cylindrical portion for oscillating with respect to the transversal axis to the axis of the ski when the base is fixed to the ski;

the cylindrical portion comprises a first housing in which an intermediate portion of the braking lever is housed;

the braking lever comprises an activation arm for being pressed by the heel of the ski boot;

the braking lever comprises a first brake arm which projects beneath the rest surface of the ski, when the base is fixed to the ski and the braking lever is in the braking position, and which is above the rest surface of the ski, when the base is fixed to the ski and the braking lever is in the non-active position; and the activation arm and the first brake arm are opposite one another with respect to the intermediate portion of the braking lever.

3. The rear portion of a ski mountaineering binding of claim 1, wherein:

the braking lever comprises a second brake arm which projects beneath the rest surface of the ski, when the base is fixed to the ski and the braking lever is in the braking position, and which is above the rest surface of the ski, when the base is fixed to the ski and the braking lever is in the non-active position;

the second brake arm is connected to the intermediate portion of the braking lever; and the first brake arm and the second brake arm are arranged in such a way that the ski is interposed between the first brake arm and the second brake arm, when the base is fixed to the ski.

4. The rear portion of a ski mountaineering binding of claim 1, wherein:

the braking lever is wire-shaped;

the activation arm of the braking lever comprises a first prong and a second prong which are solidly constrained to one another;

the intermediate portion of the braking lever comprises: a first L-shaped element which is connected, at an end, to the first prong and, at the other end, to the first brake arm; a second L-shaped element which is connected, at an end, to the second prong and, at the other end, to the second brake arm;

the first L-shaped element is housed in a first housing of the rotation member;

the rotation member comprises a second housing; and the second L-shaped element is housed in the second housing of the rotation member.

5. The rear portion of a ski mountaineering binding of claim 1, wherein:

the rotation member has a first base and a second base which are opposite one another;

a first housing of the rotation member forms a first radial undercut which extends parallel to the axis of the same rotation member starting from the first base; and a second housing of the rotation member forms a second radial undercut which extends parallel to the axis of the same rotation member starting from the second base.

6. The rear portion of a ski mountaineering binding of claim 1, wherein:

the connecting means comprise a connecting element which, on one side, is fixed to the rotation member in a position such that it partially winds around the rotation member and, on the other side, it is solidly constrained to the base;

the connecting means comprise a first abutting element which is borne by the turret; and the connecting element and the first abutting element are arranged with respect to one another in such a way that when the turret is rotated from the first turret position to the second turret position the first abutting element intercepts the connecting element generating a second rotation torque on the rotation member which brings the braking lever into the non-active position, against the action of the first elastic means.

7. The rear portion of a ski mountaineering binding of claim 1, wherein the connecting element is a wire.

8. The rear portion of a ski mountaineering binding of claim 6, wherein: the connecting means comprise a return member which is interposed between the rotation member and the first abutting element; the connecting element partially winds about the return member.

9. The rear portion of a ski mountaineering binding of claim 1, wherein:

the rotation member is provided with a first arched cogging;

the turret comprises a second abutment;

the connecting means comprise a connecting element which is movable by translation, and which comprises a second straight cogging and a third abutting element;

the connecting element is coupled to the rotation member by enmeshing of the relative second straight cogging with the first arched cogging so that a translating movement of the connecting element determines a rotation of the rotation member, and vice versa;

second elastic means are arranged to solicit the turret;

when the braking lever is in the braking position the turret can rotate from the first turret position towards a third turret position, which precedes the second turret position, at which the second abutment interferes with the third abutting element, thus preventing a further rotation of the turret to reach the second turret position; and the second elastic means are configured in such a way that when the turret is in the third turret position the second elastic means determine a third rotation torque on the turret which tends to bring the turret into the second turret position once the braking lever is brought from the braking position into the non-active position.

10. The rear portion of a ski mountaineering binding of claim 1, wherein:

a pusher is provided which is moved by the second elastic means; and the turret comprises: a first seat which is arranged to receive the pusher when the turret is in the first turret position, so that the action of the second elastic means stabilises the turret in the first turret position; a second seat which is arranged to receive the pusher when the turret is in the second turret position, so that the action of the second elastic means stabilises the turret in the second turret position.

11. The rear portion of a ski mountaineering binding of claim 1, wherein the turret and the second seat are both conformed in such a way that when the turret is in the third turret position, the pusher only partially engages the second seat, generating, via the second elastic means, the third rotation torque.

12. The rear portion of a ski mountaineering binding of claim 1, wherein it comprises a heel lifter so as to offer a support for the heel of a ski boot for walking uphill.

13. A rear portion of a ski mountaineering binding, comprising:

a base which is fixable to a ski;

a turret which is borne by the base and which is rotatable with respect to the base in order to assume a first turret position, wherein it is fixable to the heel of a ski boot, so that it is possible to ski downhill, and in order to assume a second turret position, wherein it is not fixable to the heel of a ski boot, so that it is possible to walk uphill;

a brake for a ski;

wherein:

the brake comprises a braking lever which is rotatable to assume a braking position, in which it can brake a ski when the base is fixed to the ski, and a non-active position, in which it is non-active;

the brake comprises first elastic means for rotating the braking lever towards the braking position;

the braking lever is arranged so as to be pressable by the heel of the ski boot, when the base is fixed to the ski and the turret is in the first turret position, in order to reach the non-active position against the action of the first elastic means;

further comprising:

a rotation member which is rotatingly borne by the base and which in turn bears the braking lever so that a rotation of the rotation member corresponds to a rotation of the braking lever, and vice versa; and connecting means which connect the rotation member and the turret to one another, in such a way that the rotation member and the turret are solidly constrained to one another, when the turret is in the second turret position and when the braking lever is in the non-active position, so that it is possible to walk uphill, wherein:

the rotation member is provided with a first arched cogging;

the turret comprises a cam;

the connecting means comprise a connecting element which is movable by translation, and which comprises a second straight cogging and a cam follower;

the connecting element is coupled to the rotation member by enmeshing of the relative second straight cogging with the first arched cogging so that a translating movement of the connecting element determines a rotation of the rotation member, and vice versa; and the cam of the turret engages with the cam follower of the connecting element when the turret is rotated from the first turret position to the second turret position, so that the connecting element generates a first rotation torque on the rotation member which brings the braking lever into the non-active position, against the action of the first elastic means.

14. A rear portion of a ski mountaineering binding, comprising:

a base which is fixable to a ski;

a turret which is borne by the base and which is rotatable with respect to the base in order to assume a first turret position, wherein it is fixable to the heel of a ski boot, so that it is possible to ski downhill, and in order to assume a second turret position, wherein it is not fixable to the heel of a ski boot, so that it is possible to walk uphill;

a brake for a ski;

wherein:

the brake comprises a braking lever which is rotatable to assume a braking position, in which it can brake a ski when the base is fixed to the ski, and a non-active position, in which it is non-active;

the brake comprises first elastic means for rotating the braking lever towards the braking position;

the braking lever is arranged so as to be pressable by the heel of the ski boot, when the base is fixed to the ski and the turret is in the first turret position, in order to reach the non-active position against the action of the first elastic means;

further comprising:

a rotation member which is rotatingly borne by the base and which in turn bears the braking lever so that a rotation of the rotation member corresponds to a rotation of the braking lever, and vice versa; and connecting means which connect the rotation member and the turret to one another, in such a way that the rotation member and the turret are solidly constrained to one another, when the turret is in the second turret position and when the braking lever is in the non-active position, so that it is possible to walk uphill, wherein:

the rotation member is provided with a first arched cogging;

the turret bears a first abutment;

the connecting means comprise a connecting element which is movable by translation, and which comprises a second straight cogging and a second abutment element;

the connecting element is coupled to the rotation member by enmeshing of the relative second straight cogging with the first arched cogging so that a translating movement of the connecting element determines a rotation of the rotation member, and vice versa; and when the braking lever is in the non-active position the turret can reach the second turret position, so that the first abutment abuts the second abutting element preventing the braking lever from being brought into the braking position due to the action of the first elastic means.

* * * * *